United States Patent [19]

Paquin

[11] 4,407,693

[45] * Oct. 4, 1983

[54] APPARATUS FOR MAKING LOW CROSSTALK RIBBON CABLE

[75] Inventor: Patrick J. Paquin, Hamden, Conn.

[73] Assignee: Allied Corporation, Toledo, Ohio

[ * ] Notice: The portion of the term of this patent subsequent to May 13, 1997 has been disclaimed.

[21] Appl. No.: 246,798

[22] Filed: Mar. 23, 1981

[51] Int. Cl.[3] ..... H01B 13/00

[52] U.S. Cl. ..... 156/436; 29/755; 156/555

[58] Field of Search ..... 174/34, 117 F; 156/179, 156/178, 52, 436, 552, 555, 148; 29/755; 57/19

[56] References Cited

U.S. PATENT DOCUMENTS

| | | | |
|---|---|---|---|
| 491,109 | 2/1893 | Holman | 174/34 |
| 1,907,651 | 5/1933 | Morgan et al. | 57/65 |
| 3,579,823 | 5/1971 | Greasitt | 174/34 |
| 4,202,722 | 5/1980 | Paquin | 156/436 |

*Primary Examiner*—Michael W. Ball

*Attorney, Agent, or Firm*—James P. DeClercq

[57] ABSTRACT

Several embodiments of reduced crosstalk ribbon cable having alternating twisted and straight sections of indefinite length are disclosed, crosstalk being reduced by differing starting positions of alternate twisted pairs, differing lay of alternate twisted pairs, and variation in lay along the length of alternate twisted pairs. A preferred embodiment uses offset starting positions, and a lay in alternate twisted pairs substantially longer than that of adjacent pairs, becoming shorter to minimize the nontwisted portion resulting from the time to bring adjacent pairs into planar alignment. An apparatus for making such cable is also disclosed, having several wire supply twisters and several second twisters, removing the twist inserted by the wire supply twisters while forming twisted pair ribbon cable sections, allowing indefinitely long twisted sections. Twisters are provided in two groups operating in opposite directions, preventing curl of the cable. The paired conductors are maintained in precisely laterally spaced relationship by heat bonding to thermoplastic film.

19 Claims, 2 Drawing Figures

APPARATUS FOR MAKING LOW CROSSTALK RIBBON CABLE

CROSS REFERENCE TO RELATED APPLICATIONS

This application is related to U.S. Patent application Ser. No. 246,800, entitled "Method of Making Low Crosstalk Ribbon Cable", filed 3-23-81, and owned by the instant assignee.

BACKGROUND OF THE INVENTION

It has become increasingly important to accurately space insulated multiple conductors with respect to each other, and laminated or bonded flat ribbon cable has increasingly come into use for this purpose. Precise control of electrical characteristics such as impedance, capacitance, crosstalk and attenuation, especially important in digital data and signal transmission, may be thereby achieved. The control of regular spacing and irregular spacing of multiple conductors in ribbon cable form has been achieved, in the prior art, by laminating or bonding multiple conductors to a thin plastic film, such as 5 mil polyvinyl chloride (PVC) film or a 5 mil polytetrafluoroethylene film, such as that produced under the registered trademark Teflon, either by heat-bonding, adhesive bonding, or solvent bonding.

Multiple pairs of insulated twisted pair conductors have also been accurately laterally spaced in ribbon cable, by laminating multiple pairs of insulated twisted conductor pairs between, or to, thin plastic sheet or film, the twisted pairs first being laid onto a first plastic film, and either bonded to the plastic film, or retained by a second plastic film laminated to the first film. The use of twisted pairs in multiconductor cable is of great importance in the field of communications, data processing, and other applications where crosstalk in signal transmission must be kept to a minimum. In order to facilitate the connection of twisted pair cable to a mass termination device, such as an insulation displacement connector, a twisted pair multiconductor ribbon cable has been provided with intermittent straight sections, having the required accuracy in the spacing of the ends of the multi-conductor cable, as disclosed in U.S. Pat. Nos. 4,034,148; 4,096,006, and 4,202,722 owned by the instant assignee, and hereby incorporated by reference.

However, the prior art does not disclose a ribbon cable, or a method of making it, that can be made with twisted sections of indefinite length, or made in a configuration which reduces the crosstalk between conductor pairs beyond that obtainable by simply twisting adjacent cable pairs to take advantage of the common mode rejection characteristics of conventional receiving devices connected to a conductor pair, in a manner which is controllable and repeatable. As is known in the field of telephone communications, a low crosstalk cable may be made by combining a plurality of twisted conductor pairs having a variety of lays, or length of twist, and twisting the twisted pairs in groups, and twisting the groups together to form a round cable of random orientation of the conductors, it being desired to prevent any portion of one conductor from being parallel to a portion of an adjacent conductor, whereby there will be the greatest amount of electrical energy transferred between the conductors. As will be apparent, a random orientation may randomly produce high crosstalk as well as randomly produce low crosstalk, and is not appropriate for mass termination, since each individual wire must be manually untwisted and manually connected.

The invention is therefore, directed towards an improved multi-conductor ribbon cable, and a method and apparatus for making such cable, the cable having a plurality of twisted insulated conductor pairs in combination with intermittent straight sections having precise lateral spacing, and an arrangement within the twisted portion which reduces the crosstalk between adjacent pairs of insulated conductors within the twisted section, towards that obtainable from an optimized randomized round cable, while at the same time, precisely orienting the termination points of the conductors for simultaneous mass termination.

SUMMARY OF THE INVENTION

The instant invention is directed to several embodiments of a reduced-crosstalk ribbon cable, and a method and apparatus for making such cable, preferably having a first laminating plastic film on which is placed a plurality of pairs of insulated conductors, each of said pairs of insulated conductors having alternate twisted portions and straight portions, and a second laminating plastic film which encapsulates and orients the plurality of insulated conductor portions along a precise predetermined lateral spacing. Alternatively, the pairs of insulated conductors may be bonded to a single plastic film.

The first and second plastic films are preferably heat welded or heat sealed under pressure to each other, in the nip areas on either side of the conductors, and the films may also be heat welded to the insulation of the conductor portions themselves in order to further anchor the individual conductors or conductor pairs, with respect to adjacent individual conductor or conductor pairs. Such a cable produced by bonding conductors to a single plastic film is preferably produced by heating the plastic film and conductor insulation to heat weld it under pressure.

In either case, the twisted portions have alternate conductors which vary in the starting position of the lay or twist length, and may vary in lay between adjacent pairs of conductors, or along the length of a conductor pair with respect to an adjacent conductor pair, to controllably reduce crosstalk between conductor pairs.

Mass termination of the cable occurs by simply transversely slitting the cable within a straight cable portion, and mass terminating the conductor ends onto an insulation displacing connector, or other connector, having mass termination contacts spaced equally to that of the precise spacing between the straight portions of adjacent conductors.

The method of the invention involves the following steps:

(a) providing an initial reverse twist to pairs of insulated conductors, in two groups, one group being twisted in a direction opposite to the other;

(b) passing each conductor pair through an appropriate twisting apparatus, which intermittently rotates in the same direction as the particular pair is twisted, to untwist that pair in operation, while forming a twisted pair conductor for a cable according to the invention. Preferably, the twisting apparatus is arranged in two groups, corresponding in intermittent rotational direction to the twist direction of the wires passing through it. In accordance with the invention, one group of twisting apparatus is offset from the other group of twisting apparatus, to offset or stagger the starting positions of twisted portions of individual conductor pairs within the twisted portions of the multiple conductor ribbon cable, and each group of twisting apparatus is operable at a different speed than the other group, for providing a variation in lay between adjacent pairs of twisted conductors, and within an individual twisted conductor pair;

(c) terminating the twisting of the moving conductor pairs by the twisting apparatus, but not the forward travel of the conductor;

(d) immediately after the termination of twisting, positively maintaining each of the moving, insulated conductors along straight, precisely laterally spaced paths, for a predetermined distance, thereby forming the intermediate straight portions of the multi-conductor cable;

(e) alternately bonding the twisted portions of the conductors and the straight portions of the conductors to a plastic sheet, or between plastic sheets, while positively maintaining precise lateral spacing of both the twisted portions and straight portions during bonding;

(f) in a second cycle, commencing twisting of the moving conductors into twisted pairs after formation of the straight portions of the multiconductor cable has been completed; and (g) cooling the laminated cable so formed.

The apparatus for performing the foregoing process involves the following:

(a) a first plurality and a second plurality of rotating wire supply members, for supplying and twisting moving conductors in first and second directions, respectively;

(b) an in-line twisting apparatus for forming twisted pairs of a ribbon cable according to the invention having a first section and a second section, the first section being rotatable in the first direction and receiving moving conductors from the wire supply twisted in the first direction, and having a second section, rotatable in the second direction, receiving moving conductors from the wire supply twisted in the second direction, the first section being longitudinally offset from the second section;

(c) means for precisely starting and stopping first and second sections of the twisting apparatus including means for stopping the first and second sections in a precisely predetermined conductor orientation;

(d) means for maintaining a series of straight conductor portions immediately after cessation of each twist phase of the process including a comb movable with, and between, the conductors, to maintain the precise lateral spacing between conductors just prior to bonding;

(e) means for precisely aligning the twisted pairs during the bonding including a first roller having a series of channels or grooves therein for containment and precise spacing of each twisted conductor pair during bonding of the twisted portions of the cable; and (f) means for maintaining precise alignment of the straight portions of the cable during bonding including a second roller having a series of channels or grooves therein for containment and precise spacing of individual insulated conductors of the straight portions during the bonding thereof, the first and second rollers being sequentially positioned for the bonding of the alternating twisted and straight portions, respectively.

The resulting multi-conductor cable of this invention may be briefly described as one which comprises;

(a) a plurality of insulated wire conductor pairs, each of the insulated conductor pairs having alternating twisted portions and straight portions;

(b) alternate ones of the twisted portions of insulated conductor pairs having a starting position longitudinally displaced from the starting position of an adjacent twisted portion, and having a lay or length of twist which may differ from that of an adjacent pair of twisted conductors, and which may vary in pitch or length of twist within its length; and, alignment means for aligning said insulated conductor pairs in a predetermined laterally spaced relationship with respect to each other, the alignment means preferably comprising a laminated plastic film having a plurality of spaced encapsulating ducts formed therein, each said encapsulating duct containing either an individual straight conductor portion or an insulated conductor twisted pair portion, and having nip areas extending laterally between, and joining, each of said spaced encapsulating ducts, and alternatively comprising a single plastic film to which insulated conductor pairs are bonded in the predetermined spaced relationship with respect to each other.

BRIEF DESCRIPTION OF THE DRAWINGS

FIG. **9*a* is a cross-sectional view taken along the line 9*a*—9*a* of FIG. 9 when twisted conductor portions are being bonded.

FIGS. 25 and 26 show schematic plan views of different forms of ribbon cable made by the process and apparatus of the invention, FIG. 25 showing an alternately interchanged straight conductor sequence.

DESCRIPTION OF THE PREFERRED EMBODIMENTS

Figure 1:
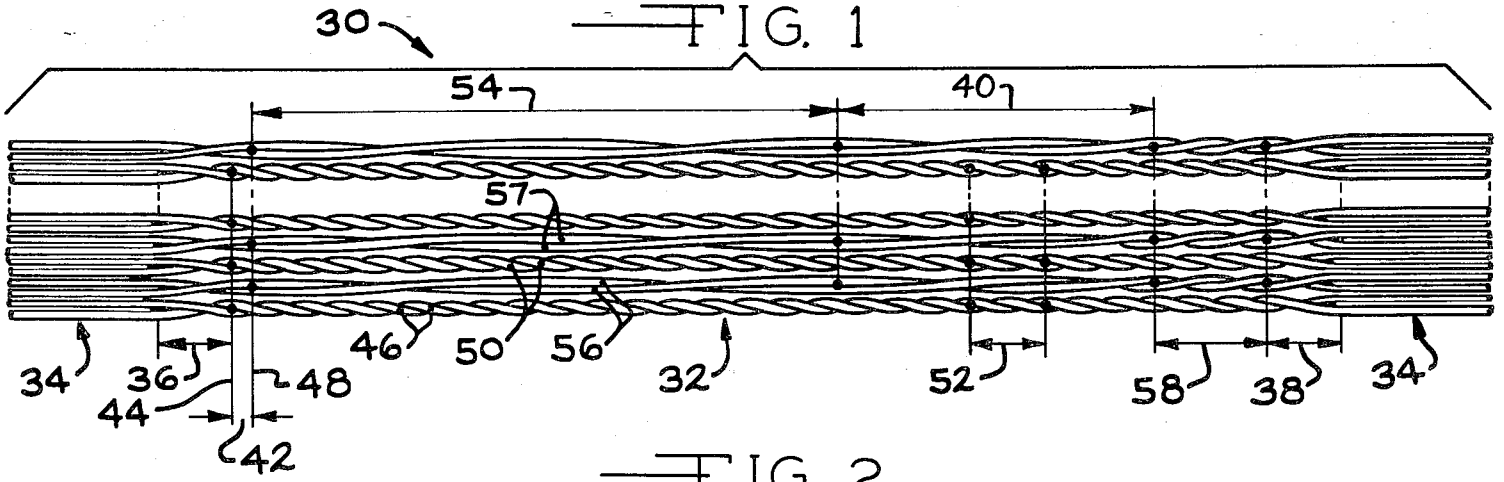
FIG. 1 is a top elevational view of a first preferred embodiment of ribbon cable according to the instant invention.
Figure 2:
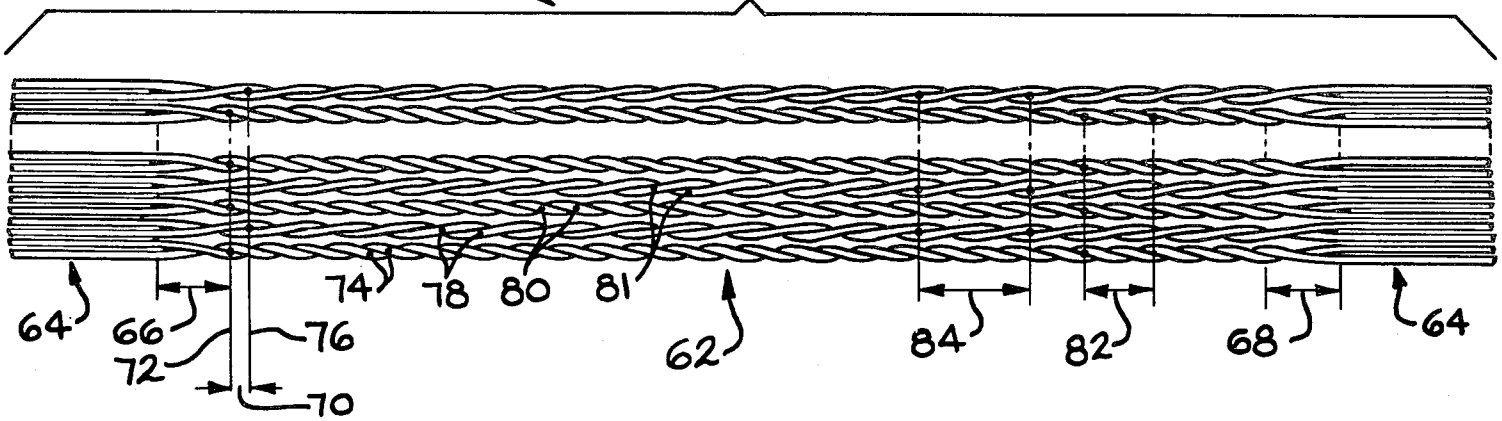
FIG. 2 is a top elevational view of a ribbon cable according to a second preferred embodiment of the invention.
Figure 3:
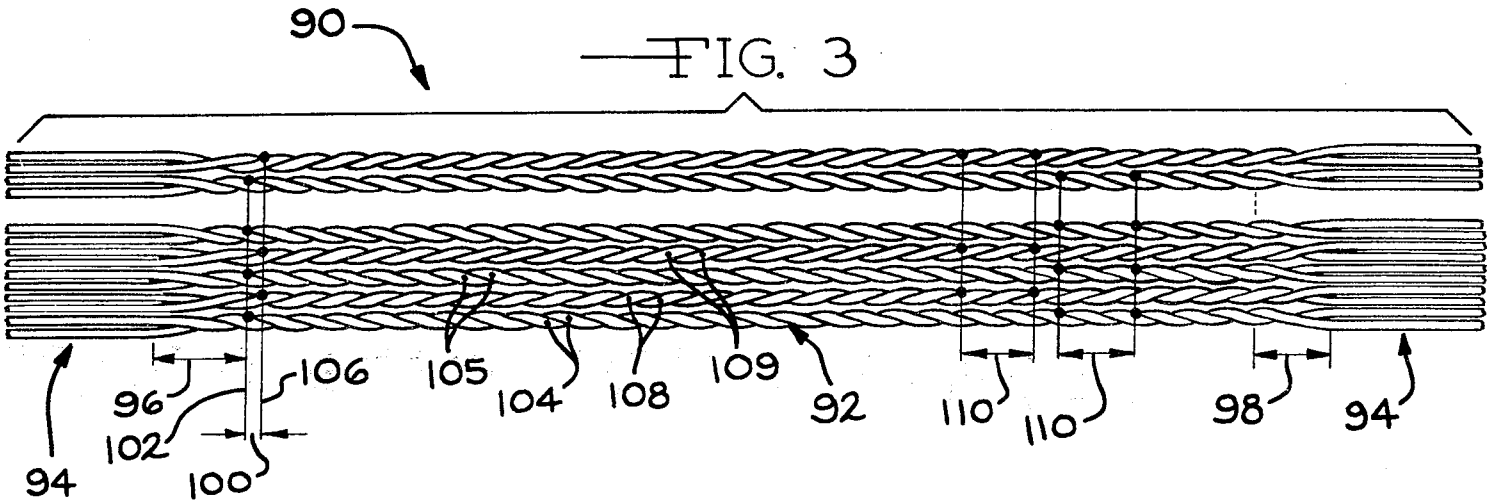
FIG. 3 is a top elevational view of a third preferred embodiment of a ribbon cable according to the invention.
Figure 5:
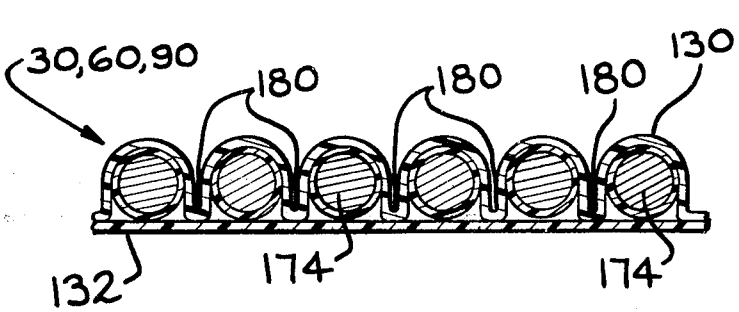
FIG. 5 is a partial cross-sectional view of a cable according to the invention taken within a straight portion of a cable according to the invention.
Figure 4:
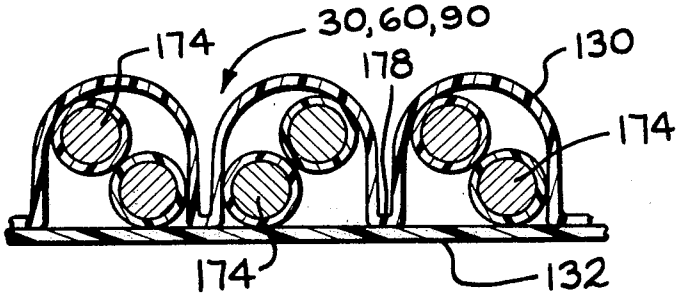
FIG. 4 is a partial cross-sectional view of a ribbon cable according to the invention, taken within a twisted portion of the cable.

FIGS. 1, 2 and 3, as well as FIGS. 4 and 5, relate to three different embodiments of reduced crosstalk ribbon cable, each having a twisted pair section, a straight or flat section, and transition sections arising due to the offset twist start positions and/or the differeing lay or twist length of alternating pairs of conductors, one of which may require twisting for a randomly longer period of time until its individual conductors are aligned in the plane of the cable.

FIG. 1 shows a first preferred embodiment 30 of a ribbon cable according to the invention having twisted portions 32, straight or flat portions 34, transition regions 36, 38 and 40, and an offset start distance 42 between the start position 44 of a first conductor pair 46, 50 etc., and the start position 48 of a secnd conductor pair 50, 57 etc., having a second lay 54 and opposite rotation in twisted portion 32. As shown, conductor pairs 46, 50 etc., have a first lay 52, and conductor pairs 56, 57 etc., have a second lay 54 with its own transition region 40. Also shown is the opposite rotation for alternating pairs; i.e., clockwise/counterclockwise or counterclockwise/clockwise. In an actual embodiment of a cable produced in accordance with FIG. 1, first lay 52 was approximately 0.5 inches (1.27 cm) and second lay 54 was approximately 2.0 inches (5.08 cm) with its rapid transition region 40 reduced to a 0.75 inch (1.91 cm) third lay 58 before entering the straight or flat section 34. As will be apparent, the difference between the first lay 52 and the second lay 54, together with the offset start distance 42, prevents portions of first conductor pairs 46, 50 etc., from lying parallel to portions of second conductor pairs 56, 57 and their repetitive counterparts.

As will be explained in greater detail below, transition regions 36 vary in length in a somewhat random manner, being due to the time and distance required to bring separate twisting apparatus to a stop with individual insulated conductors lying in the plane of the cable. It will be apparent that one of two twisting apparatuses will almost always stop before the other and that both of two must be stopped before formation of the precisely aligned straight flat portion 34 can begin.

A ribbon cable according to FIG. 1 has been tested with a five nonosecond rise time signal applied to one conductor of the twisted pair 56 (ground-signal configuration) and found to have an average 5.7 percent crosstalk, which is a 12.3 percent improvement over the average 6.5 percent crosstalk measured for an equivalent section of ribbon cable with adjacent conductor pairs having identical lay and aligned starting positions.

It should be noted that all three disclosed embodiments have a theoretical or calculated improvement in crosstalk of approximately 26.3 to 29 percent or greater, over a prior ribbon cable, which is the subject of U.S. Pat. No. 4,202,722, issued May 13, 1980. However, in present actual embodiments, difficulty in precisely measuring relatively small absolute differences, together with unavoidable minor variations in mechanical characteristics of ribbon cable and of its individual insulated conductors, has produced experimental results differing from predicted values.

FIG. 2 shows a second preferred embodiment of a ribbon cable, according to the invention, also having electrical characteristics much superior to that of conventional ribbon cable. Ribbon cable 60 includes twisted portions 62, straight or flat portions 64, and transition regions 66 and 68, as well as an offset start position distance 70 between the start position 72 of first conductor pairs 74, 80 and start position 76 of third conductor pairs 80, 81, etc. As illustrated, first conductor pair 74, 80 has a first lay 82 and second conductor pair 78, 81 has a second lay 84. It should be noted that the opposite twist rotations of the adjacent pairs, alternately disposed across the width of a ribbon cable according to the invention, is not absolutely necessary to utilize the advantages of the invention, although, as will be apparent to one skilled in the art, providing alternating conductor pairs with opposite directions of twist will provide balanced torsional forces within a ribbon cable and will prevent spiral twisting of the ribbon cable such as would occur if all pairs were twisted in the same direction.

As above, transition regions 66 and 68 result from the fact that adjacent pairs have different lays, 82 and 84, and alternating pairs have an offset start position distance 70 to minimize crosstalk and, therefore, since first conductor pairs 74, 80 and second conductor pairs 78, 81 must have their respective individual conductors in the plane of the cable to form straight or flat portions 64, apparatus for separately twisting first conductor pairs 74, 80 and second conductor pairs 78, 81 will, of necessity, stop the twisting of one of said pairs at a later time than the twisting of the other. In an actual embodiment of the invention as shown in FIG. 2, first lay 82 was 0.5 inches (1.27 cm) and second lay 84 was 0.75 inches (1.92 cm), and exhibited an average crosstalk of 6.0 percent, a 7.7 percent improvement over a conventional ribbon cable when tested in the same manner as the ribbon cable 30 shown in FIG. 1.

FIG. 3 shows a third preferred embodiment of a ribbon cable 90 according to the invention. Ribbon cable 90, when tested, exhibited improved characteristics compared to those of a standard ribbon cable although not to the same extent as the characteristics of the ribbon cables 30 and 60 shown in FIGS. 1 and 2, respectively. Ribbon cable 90 has a twisted portion 92, a straight or flat portion 94, transition regions 96 and 98, as well as an offset start position distance 100 between the start position 102 of the first conductor pairs 104, 105 and the start positions 106 of second conductor pairs 108, 109.

As shown, first conductor pairs 104, 105 and second conductor pairs 108, 109 have an identical lay 110, in opposite twist rotation, and are offset or staggered by offset start position distance 100. In an actual embodiment of a cable according to the invention the lay 110 was approximately 0.5 inches (1.27 cm) which, together with an offset start position distance 100 of 0.125 inches (0.32 cm), eliminated the nearly perfect alignment between adjacent conductor pairs found in conventional cable and, when tested in the same manner as ribbon cables 30 and 60, produced an average crosstalk of 5.5 percent, an improvement of 15.7 percent over a ribbon cable having adjacent conductor pairs with equal lay and aligned starting positions.

Figure 6:
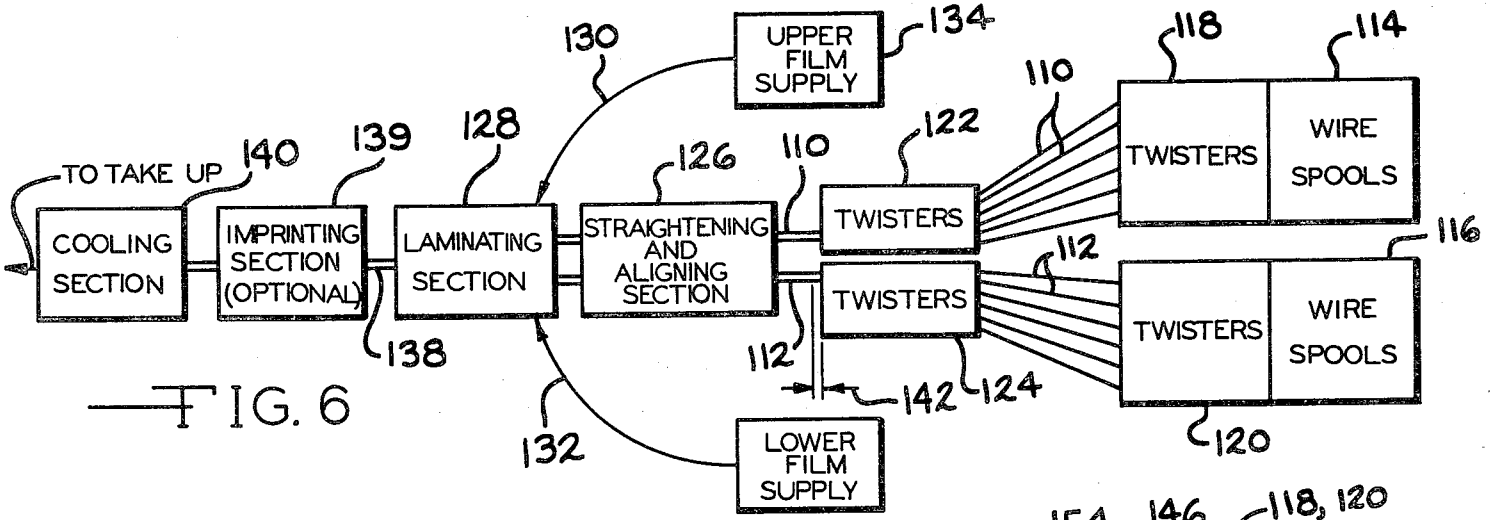
FIG. 6 is a block diagram indicating the main process and apparatus stations employed in making an improved ribbon cable according to the invention.

Referring now to FIG. 6, an overview of the various process and apparatus stations will first be set forth. Individual insulated conductors, designated by the reference numbers 110 and 112 are unwound from a series of spools 114 and 116, here shown diagramatically only, conductors 110 passing through twisting apparatus 118 from spools 114, and conductors 112 passing through twisting apparatus 120 from spools 116. As will become apparent, there are a plurality of wire spools 114 and twisting apparatus 18, and of wire spools 116 and 120, there being two wire spools and one twisting apparatus for each pair of insulated conductors. As shown, insulated conductors 110 pass through second twisting apparatus 122, and insulated conductors 112 pass through second twisting apparatus 124. As will be explained in greater detail below, twisting apparatus 118 and twisting apparatus 122 are operated in a first rotational direction, and twisting apparatus 120 and 124 are operated in a second rotational direction opposite to the first rotational direction. In effect, twisting apparatus 118 twists the wires supplied from spools 114, and twister 122 untwists conductors 110 from twisting apparatus 118, in the process of forming twisted pairs, so that the insulated conductors 110 between twisting apparatus 118 and twisting apparatus 122 will remain relatively untwisted. The same is true with regard to twisting apparatus 120 and 124, and the insulated conductors 112 between twisting apparatus 120 and twisting apparatus 124. In this manner, an indefinitely long twisted pair section may be formed in a ribbon cable such as ribbon cable 30, 60, or 90, since conductors 110 and 112, lying between twisting apparatus 118 and 122, and 120 and 124, respectively, will not become overly twisted and break, as they would if fed directly from wire spools 114 or 116. In the absence of twisting apparatus shown as twisters 118 and 120, only a limited length of twisted pair section could be fabricated before it became necessary to stop and reverse twisting apparatus such as is shown as twisters 122 and 124 to remove the excessive twist from insulated conductors 110 and 112 between twisting apparatus shown as separate twisters 122 and 124 and their respective wire supply spools, such as spools 114 and 116. As shown, insulated conductors 110 and 112 then pass through a straightening and aligning zone or station 126, and thence into a laminating or bonding zone or station 128. In accordance with one embodiment of the invention, plastic laminating sheets 130 and 132, are fed from spools 134 and 136, respectively, to encapsulate both the twisted portions of the cable and the alternating straight portions, which are then laminated under heat and pressure, to produce thereby a hot laminated multi-conductor cable having alternating twisted and straight sections. Alternatively, as will become apparent, the same equipment and films may be used, if desired, to produce a cable according to the invention with individual conductors bonded to one surface of one plastic sheet, either without the use of a second plastic sheet, or with a second plastic sheet which has been treated to prevent bonding.

The thus formed cable 138 may then be passed through an imprinting section 139 for affixation of codings, trademarks, or other markings, and then to a cooling section 140, for cooling, before being wound onto take-up spools, not shown, in a conventional manner. A constant-speed motor, of conventional design, not shown, is employed to pull the cable through the various stations just outlined, under a constant and predetermined tension. Twisting apparatus shown as separate twisters 122 and 124 produces twisted portions in cable 138 which start at alternatingly offset positions, to reduce alignment between conductors 110 and 112, to reduce crosstalk between conductors 110 and 112, by virtue of a distance 142 representing the distance by which a twisting apparatus shown as twister section 124 is offset from a separate twisting apparatus, shown as twister 122.

It should be specifically noted that either starting time or longitudinal alignment of twisters 122 and 124 may be offset, the two types of offsets being equivalent, but the mechanical offset is preferred, since not subject to non-repeatability of timers and length counters and the like.

Figure 7:
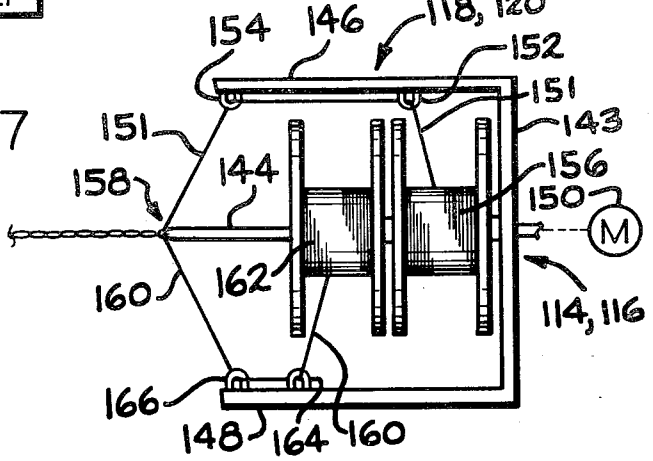
FIG. 7 is a side-elevational view of a wire supply apparatus for providing a reverse-twisted pair of moving conductors.
Figure 8:
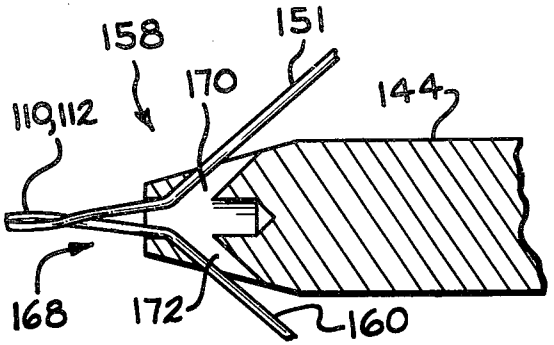
FIG. 8 is an enlarged partial view of the apparatus shown in FIG. 7.

FIGS. 7 and 8 illustrate the wire spools 114, 116 of FIG. 6, with the twisting apparatus shown as twisters 118, 120. As shown in FIG. 7, a rotatably mounted frame 143, having a central member 144 and arms 146 and 148, is rotated by a conventional motor 150. As frame 143 is rotated, a conductor 151 will be drawn through guide means 152 and 154 on arm 146 from a wire spool 156 mounted on central member 144, and through twister portion 158 of central member 144. Simultaneously, a conductor 160 is drawn from a spool 162 mounted on central member 144, through guide means 164 and 166 of arm 148, and thence to twister portion 158. As shown in FIG. 8, twister portion 158 includes a central bore 168 in central member 144, and radial slots 170 and 172 intersecting central bore 168, through which conductors 150 and 160 pass. As will be apparent, the rotation of frame 143 would thus form a twisted pair from conductors 110, 112, in conventional manner, were it not for the presence of twisting apparatus shown as twisters 122 and 124, which, rotating in the same direction as a given frame 143, removes the twist, so that conductors 110, 112, are substantially untwisted. As will be apparent, FIG. 7 illustrates only one of many such structures necessary to implement the invention. There must of necessity be one frame 143 for each pair of wires in a cable according to the invention, and preferably a separate motor 150 for turning approximately half of the frames 143 in an opposite direction, corresponding with the opposing operating directions of the twisting apparatus shown as twisters 122 and 124. As will be apparent, any of numerous conventional structures for implementing the twisters shown as 118, 120, may be used without departing from the scope of the invention. Also, as will be apparent, although twisters 122 and 124 are shown as using twisting tubes, it will be apparent that apparatus in accordance with the invention may be built with any group of rotating assemblies having two separate paths for two individual conductors, which may, for instance, be fabricated in the form of perforated disks or any other convenient configuration, without departing from the scope of the invention.

Referring particularly to FIGS. 4 and 5, the cable thus formed is shown in cross-section, FIG. 4 being a partial cross-section through a twisted section, and FIG. 5 being a partial cross-section through a flat, straight portion. Each of the individual insulated conductors 110, 112, employed in this invention, preferably comprise a central metal conductor 174, preferably made of copper or aluminium, with a preferably round polyvinyl chloride or other plastic insulation 176 formed around central metal conductor 174. The wire gauge and insulation thickness may be varied within wide limits which are well-known in the art. The first (upper) and second (lower) laminating plastic sheets designated by the numerals 130, 132, if used, may be made of polyvinyl chloride or Teflon, or other pliable, heat sealable plastic film. The thickness of the film may vary within wide limits, preferably in the order of 4 to 12 mils, although other thicknesses may also be employed depending upon the application of the finished cable 30, 60, 90.

It should be noted at this point that a cable 30, 60, 90 according to the invention may be either laminated between laminating sheets 130, 132, or bonded to a single plastic sheet 130 or 132. The typical softening temperature for thermoplastic materials such as plastics sheets 130, 132 and insulation 176 is in the order of 230° to 250° F. (111° to 123° C.). If both plastic sheets 130, 132, and insulation 176 are at temperatures within this range, the upper and lower films, 130, 132 and insulation 176 will bond together at contacting portions. If the wire is cool, which is preferable, the sheets 130, 132, will bond together, but will not bond to the insulation 176. Therefore, it will be apparent that, if wire insulation 176 is at an appropriate temperature, it can be bonded to a single plastic laminating sheet such as 130 or 132, using the apparatus described herein, either by entirely omitting the second plastic laminating sheet 130, 132, or by treating a plastic laminating sheet 130, 132 so that it will not bond. To accomplish this, plastic laminating sheet 130 or 132 is immersed in a mixture of evaporative carrier and a release agent, preferably a solution of a release agent such as silicone in an evaporative carrier of a chlorinated hydrocarbon, such as available under the trademark Freon. The Freon quickly evaporates, leaving a coating of silicone on the plastic laminating sheet 130 and 132. In this case, the finished cable has an upper sheet 130 and a lower sheet 132, one of which is removed and collected for re-use on a separate take-up spool. The Freon-silicone mixture may be applied to a plastic laminating sheet 130, 132 by an applicator 177, such as a brush-type applicator placed in its path, as well as having a supply roll emerged in a Freon-silicone solution or the like. However, this produces a less satisfactory although functional cable 30, 60, 90, conductors 110, 112 being more firmly maintained when laminated between two plastic laminating sheets 130, 132. Therefore, the remainder of the detailed description of the apparatus will generally assume that two plastic laminating sheets are used, and that both are capable of bonding, although it will be apparent that the structure disclosed will also make a single-sided cable.

If both upper and lower laminating films 130 and 132 are used, they constitute the alignment means for both the twisted pair portions 32, 62, 92 and straight portions 34, 64, 94 of the cable 30, 60, 90. The alignment is formed, during processing, by forming encapsulating ducts or channels which contain individual straight conductor portions alternating with twisted pair portions, each of these portions being precisely laterally spaced by means of heat-welded nip areas extending laterally between and joining each of the encapsulated ducts. The welded nip areas in the twisted portion of the cable 30, 60, 90 are designated by the numeral 178, and in the straight portion of the cable by the numeral 180, as best shown in FIGS. 4 and 5.

The various apparatus and process zones will now be described in detail.

Figure 9:
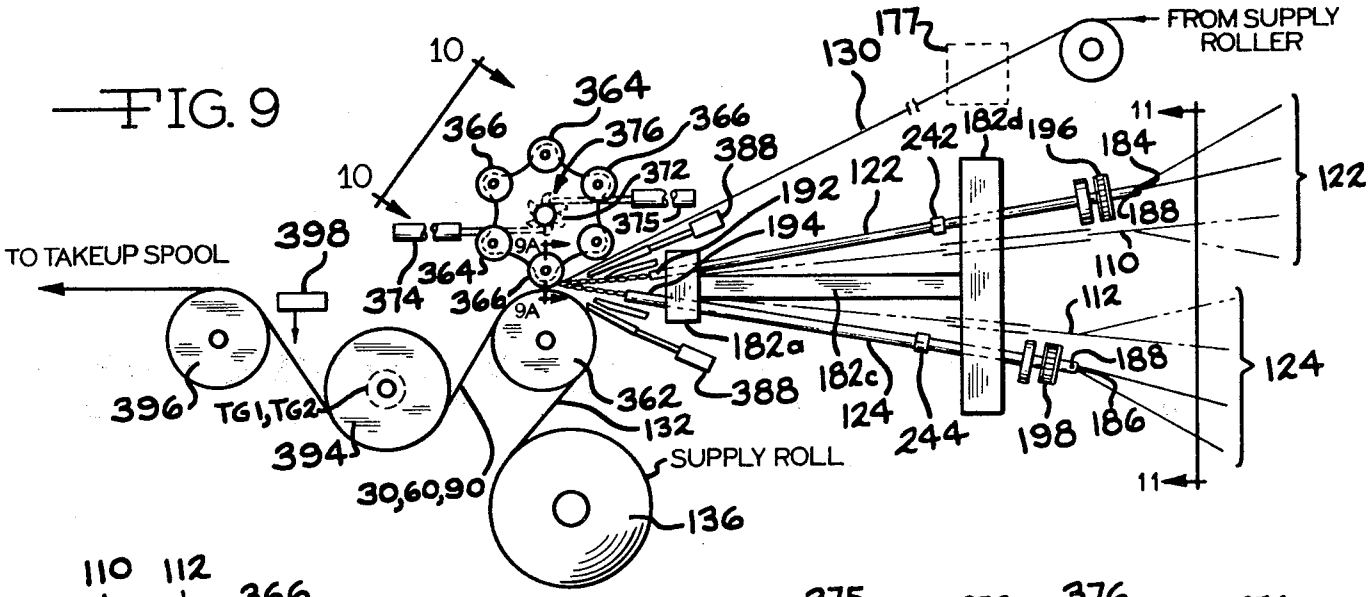
FIG. 9 is a partially diagramatic side-elevational view of the processing line for making a multi-conductor cable according to the invention.
Figure 11:
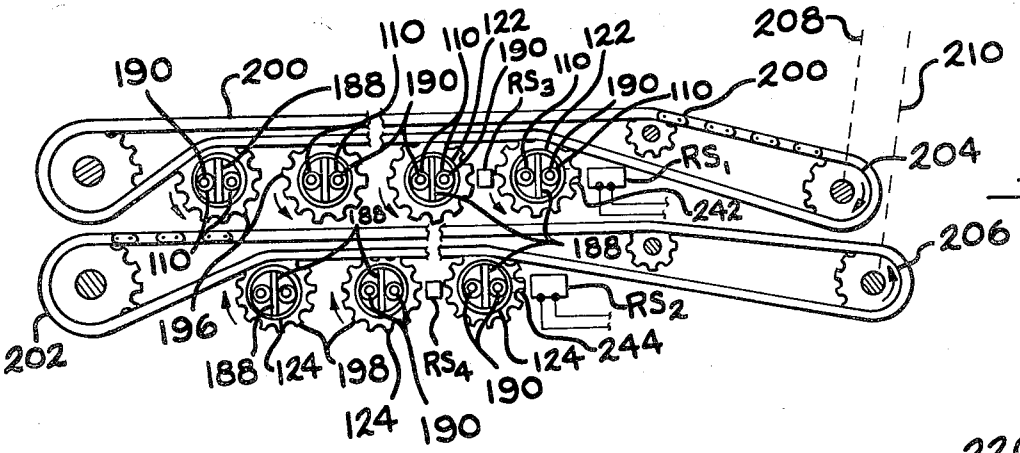
FIG. 11 is an end elevational view of a portion of the twist control apparatus, as viewed along the direction of the line 11—11 in FIG. 9.
Figures 14, 15, 16, 17:
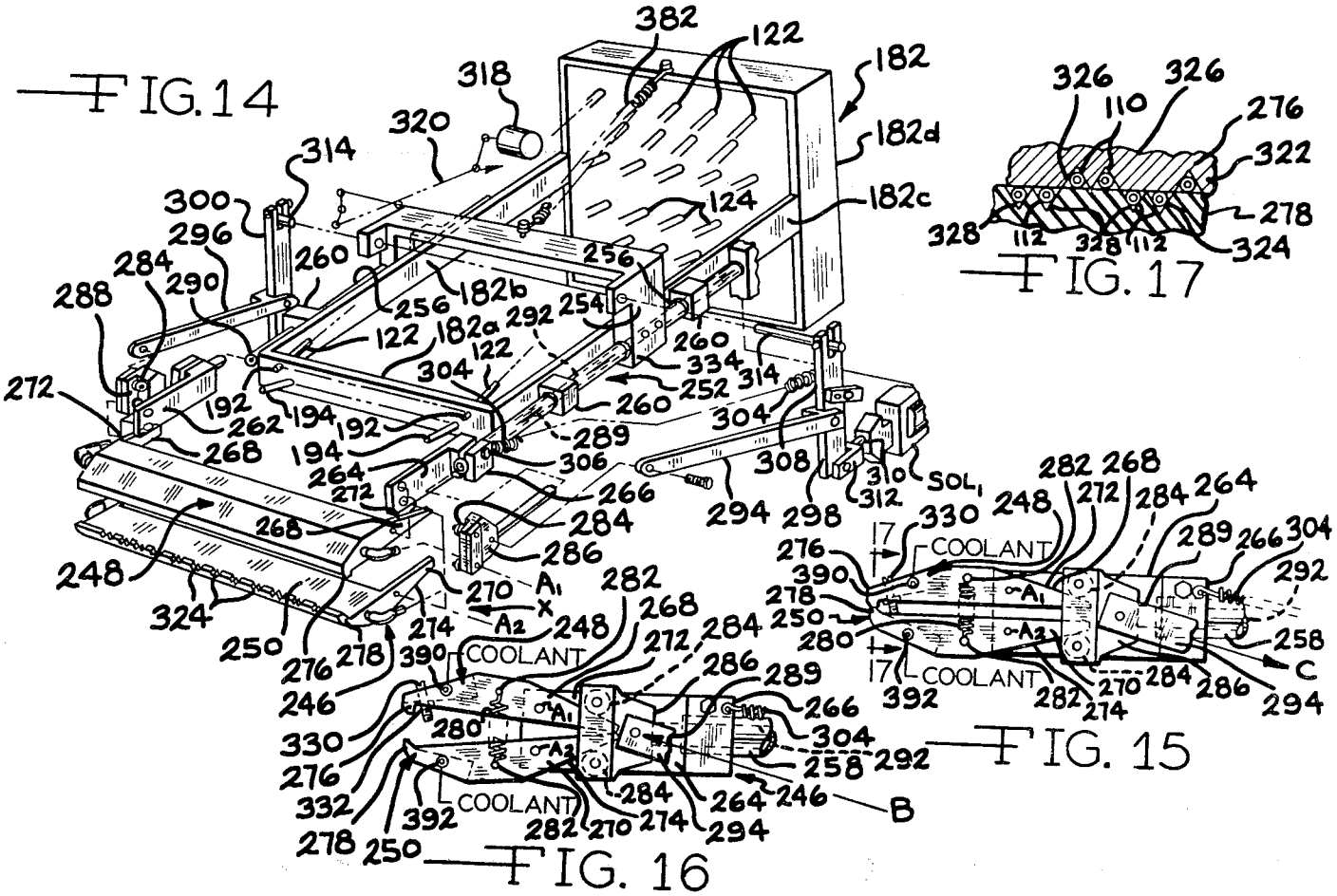
FIG. 14 is an exploded view, in perspective, of a movable carriage and comb apparatus for positively aligning portions of the moving cable into straight portions, after the twisted portions of the cable have been formed, and thereafter maintaining the straight cable portions for a predetermined cable length.
FIG. 15 is a side-elevational view of the comb apparatus of the invention in closed, clamping position, looking in the direction of arrow X of FIG. 14.
FIG. 16 is a side elevational view of the comb apparatus in open, non-clamping position, looking in the direction of arrow X in FIG. 14.
FIG. 17 is a partial, enlarged, cross elevational view of the clamping jaw of the comb, taken along the line 17—17 in FIG. 15, showing the relationship of the straight portions of the insulated conductors to the comb teeth.

Referring now to FIGS. 6, 9, and 15, especially, a plurality of pairs of individual insulated conductors 110, 112 are fed from spools 114, 116, through reverse twisters 118, 120, and into and through a plurality of twister 122, 124 shown as elongated tubes. Each of the twister tube 122, 124 are rotationally mounted, within a rigidly mounted twister frame 182. The twister frame 182 comprises an upstanding rear twister block **182*d*, a front twister block 182*a*, and side brace members 182*b*, 182*c*. The rear portions of the twister tubes 122, 124 are preferably segregated into an upper group of tubes 122 and a lower group of tubes 124. Conductor entrances 184, 186 to the twister tubes 122, 124 are spaced somewhat from each other, to permit the drive mechanism for the twister tubes 122, 124 to be mounted thereto. The spacing is best seen in FIGS. 11 and 15**.

Each twister tube 122, 124 is provided with a separating pin 188 at the entrance 184, 186, thereto, and is provided with a pair of interior conductor tubes 190, running substantially the entire length of each twister tube. The tubes 190 are stably mounted within each twister tube 122, 124, by a welding operation, or the like.

As the conductor pairs 110, 112 approach the entrance to the twister tube 122, 124, they are usually twisted to some extent due to momentary nonsynchronization of twister 118 and 122, and of twister 120 and twister 124, but as each of the conductors 110, 112 of each pair approaches the interior tubes 190, each such conductor is passed around opposite sides of the separating pin 188, and is thus separated from the other conductor in the pair, so that only a single conductor passes into each one of the interior tubes 190.

The individual conductor 110, 112 of each pair are maintained separate and distinct from the other conductor forming the pair as they pass through the interior tubes 190. Therefore, twisting of the conductors of each pair commences immediately at the point of exit of the conductors from the twister interior tubes 190, designated by the numerals 192, 194 in FIGS. 9 and 15. As shown, exits 192 and 194 are longitudinally offset with reference to the longitudinal direction of the cable 30, 60, 90, so that twisting of adjacent, alternating conductor pairs, 110, 112, will be offset or staggered from each other, by the distance 142 best shown in FIG. 6. Of course, as stated above, offset starting times would produce an equivalent result in a logically equivalent manner.

The upper and lower banks 122, 124 of twister tubes converge towards each other, to the closest extent possible, at the exits thereof, 192, 194, just forward of frame member 182*a*, so that the upper and lower banks of emerging conductor twisted pairs 110, 112 will achieve a minimal angular relationship at exits 192, 194. The upper and lower banks of twister tubes 122, 124 are themselves each in substantial horizontal alignment at their respective points of exit 192, 194, as can best be seen in FIG. 15. The conductor pairs emerge from exits 192, 194 in two closely adjacent parallel rows, in an alternating relationship.

The twister tube 122, 124, not only converge towards each other, as view in side elevation, but may converge inwardly somewhat as viewed in top plan view, as best seen in FIG. 15 although this is not desirable, since it imposes side loads on the tubes 122, 124, and causes increased friction between conductors 110, 112 and interior conductor tubes 190.

The exact special arrangement of twister tubes 122, 124, and their quantity, depends on cable width, conductor spacing, and the number of conductors desired. For example, if a 16 pair, 32 conductor cable is to be made, two rows of four twister tubes each may be mounted in the upper bank of twister tubes 122 and two rows of four twister tubes may be mounted to form the lower bank of twister tubes 124, as partially shown in FIG. 11.

Each of the twister tubes 122, 124 has a sprocket 196, 198, mounted at the rear thereof. Sprockets 196, 198 are drivable by chain means 200, 202, the chain means being in turn drivingly engaged by the sprockets 204, 206, in turn driven through driving means 208, 210, respectively. Driving means 208, 210 may be shaft or chain drives, or other positive drive means, as appropriate.

The exact pitch, or number of twists to the inches of each conductor pair, and the lay of each conductor pair, may be adjusted by adjusting the rate of conductor travel and the rate of rotation of twister tubes 122, 124. Also, the twister tubes 122, 124 may be rotated in the same or different directions, depending on the direction of the twist of each conductor pair desired in the final cable, 30, 60, 90, although the preferred embodiments of cables 30, 60, 90 are preferably made with opposite alternate twists, as shown.

Figure 13:
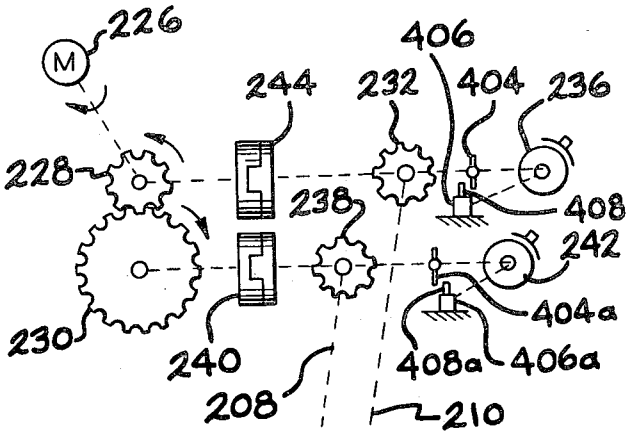
FIG. 13 is a partially diagramatic side-elevational view of a second driving apparatus for the twist control apparatus shown in FIG. 11.
Figure 12:
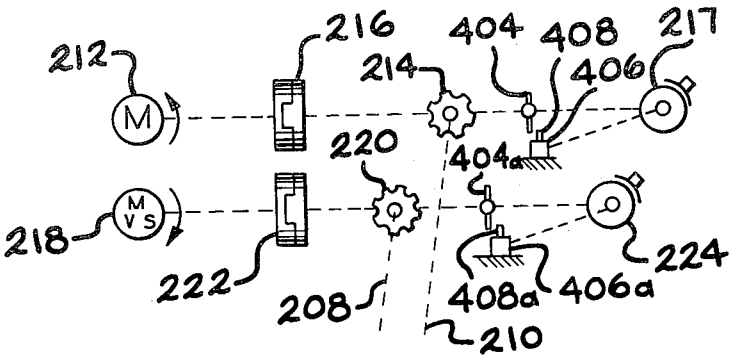
FIG. 12 is a partially diagramatic side-elevational view of a first driving mechanism for the twist control apparatus shown in FIG. 11.

Referring to FIGS. 12 and 13, two different structures for driving driving means 208 and 210 are shown. In FIG. 12, a first motor 212 drives a sprocket 214 through a clutch 216. Sprocket 214, operably coupled to driving means 210, may be stopped by means of a brake 217. A second motor, shown as a variable speed motor 218 drives a sprocket 220, operably coupled to driving means 208, through a clutch 222. Sprocket 220 may be stopped by means of a brake 224, if desired. In an actual embodiment of the invention, a brake, not shown, is interposed between motor 218 and clutch 222, to assist motor 218 in slowing from the rate needed to produce lay 58 to that for lay 54 while flat portion 34 is being produced. The structure shown in FIG. 12 is best adapted for manufacture of a cable 30, where the lay of a pair of twisted conductors varies within the length of the twisted portion, although, as will be apparent, it is also usable to produce the structure of cable 60 or 90.

In FIG. 13, a single motor 226 is operably connected to a pair of drivingly engaged gears 228 and 230. Gear 228 drives a sprocket 232 through a clutch 234. Sprocket 232 is operably coupled to driving means 210, and may be quickly stopped by means of brake 236. The rotation of gear 230 is coupled to a sprocket 238 through a clutch 240. Sprocket 238 is operably coupled to driving means 208, and may be stopped by means of a brake 242. As shown, gears 228 and 230 are of different sizes, as would be appropriate for producing cable 60, although, as will be apparent, gears 228 and 230 may be made identical, to produce a driving structure best adapted for producing the cable 90, shown in FIG. 3. As will be apparent, clutches 216, 222, 234, 240, and brakes 216, 224, 236, 242, shown in FIGS. 13 and 14 are used for driving twister tubes 122, 124 to produce twisted sections 32, 62, 92 of cables 30, 60 and 90, and for stopping twister tubes 122, 124 with conductors 110, 112 aligned in the plane of cable 30, 60, 90 to make flat straight sections 34, 64, 94 of cables 30, 60, 90.

Referring to FIG. 11, the upper and lower banks of twister tubes 122, and 124 are shown as being drivingly engaged for opposite rotation. In this way, when a twisted conductive pair from an upper bank twister tube 122 is layed into the conductive formation immediately next to a twisted pair from a lower bank of twister tubes 122, immediately adjacent twisted conductor pairs will then assume twists in opposite, or reverse, directions with respect to each other. The reversed twist direction immediately adjacent twisted pairs in the electrical cable 30, 60 or 90 is of advantage in many aspects of electrical signal transmission and mechanical features of ribbon cables.

As the twister tubes 122, 124 commence rotation, upon energization of twist motor 212, 218, or 226, the moving conductors of each pair commence twisting at substantially the same time, but at different places, at the respective exists 192, 194. The length of the twisted portion of the cable is determined by a counter mechanism 400, a three level present counter shown schematically in FIG. 23. The counter mechanism is conventional in design and senses and controls the length of the twisted pairs and flat sections made by sensing the movement of the cable 30, 60, 90, by a timing generator TG1, shown as coupled to cooling roller 394 in FIG. 1.

At the completion of the twist phase of the process, i.e., at the end of the first counter level C1, the clutch of the twist motor 212, 218, 226 is disengaged and positively stopped by a conventional brake means shown schematically in FIGS. 12 and 13.

Figure 18:
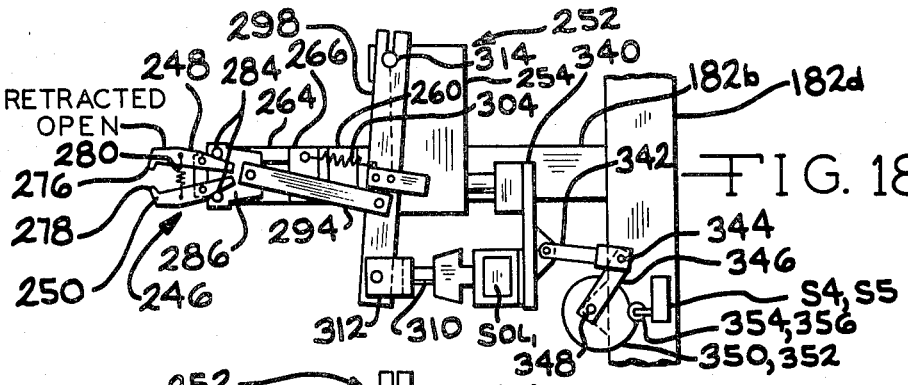
FIGS. 18–21 are partial, side-elevational views of the carriage and comb apparatus of FIG. 9, as viewed in the direction of arrow X in FIG. 9, and shown in various sequenced positions of carriage travel and comb orientation, with FIG. 18 showing retracted carriage position and open comb position, FIG. 19 showing retracted carriage position and closed comb position, FIG. 20 showing forward carriage position and closed comb position, and FIG. 21 showing forward carriage position and opened comb position.

The exact position of the stop of the twist motor, such as motor 212, 218 or 226, and of driving means 208, 210 is important. It is preferably desired that the line drawn through the axis of any two conductors 110, 112, in a pair, after the twist phase, lie in a substantially horizontal planar configuration as they emerge from exits 192, 194 of the twister tubes 122, 124. This is important insofar as it is desired to have an essentially flat or planar relationship of conductors 110, 112 in the straight portions 34, 64, 94 of the cables 30, 60, 90 for connection to conventional insulation displacing connector for mass termination. To this end, one or more reed switches RS1, RS2, RS3, RS4 are energized at the end of the first level of counter 400, and are attracted by rotating magnets 242, 244, mounted upon rotating twister tubes 122, 124, to exactly index or position all twister tubes 122, 124 so that the lines drawn between the axes of each conductor, in a pair, are substantially horizontal and planar as they exist from the twister tubes 122, 124. This relationship of adjacent conductors in the upper bank of twister tubes 122 and in the lower bank 124 is best shown in FIG. 18. The closure of reed switches RS1, RS2, RS3, RS4 then close secondary electrical circuits to disengage a conventional clutch means, such as 216, 222, 234, 240 and apply brake means such as brakes 217, 224, 236 or 242.

The next step in the process, after the twist phase just described, requires that the conductor pairs now emerging from the twister tubes 122, and 124 and in substantially horizontal, planar, nontwisted relationship, be precisely aligned both in the horizontal and vertical directions, to form an essentially precisely laterally spaced flat conductor cable just prior to the lamination or bonding thereof into cable form.

In order to accomplish this, a structure shown in particular in FIGS. 15 through 22, wherein a metal comb structure 246 for holding the upper and lower banks of conductors 110, 112 in the desired relationship is provided. The comb structures 246 comprises upper and lower toothed combs 248, 250, respectively, with means for sequentially opening and closing the combs. The comb movement is controlled by a comb carriage, generally designated by the numeral 252. The comb carriage 252 and comb structure 246 will now be described.

Referring first, in particular, to FIG. 14, a rear carriage block 254 is mounted for reciprocal movement, parallel to the direction of cable travel, by means of a support such as a pair of carriage rods constituting track means 256, 258. Each of the carriage rods are slidably mounted for reciprocal movement within bushings 260. The bushings 260 are stably affixed to side member 182*b*, 182*c* of the twister frame 182.

Carriage block 254 carries the linkage means for first, sequentially controlling the opening and closing of the combs 248, 250, and, second, for sequentially controlling the forward and rearward motion of the associated comb structure 246.

The upper and lower combs 248, 250 of comb structure 246 are pivotably mounted to comb carrier members 262, 264, and are pivoted about axes transverse to the direction of cable travel, the axes being designated by the letters A1 and A2, respectively, in FIGS. 15, 16 and 17. Comb carrier members 262, 264 are fixed in the forward end of track means 256, 258, respectively by means of split nut and bolt means 266 or other suitable attachment means, and are thus movable with said track means 256, 258.

Each of the upper and lower combs 248, 250 has rearwardly extending arms 268, 270, and is provided with upper and lower converging cam surfaces 272, 274, respectively.

The frontal jaw portion 276, 278 of comb members 248, 250 are normally held together, in the position shown in FIG. 15, by means of a pair of strong coil springs 280, springs 280 being mounted at the side walls of comb members 248, 250. The upper and lower ends of each spring 280 are affixed to each of the side walls of upper and lower combs 248, 250 in a conventional manner, as by attachment rivets 282. The frontal jaw portions 276, 278, are movable to the open position shown in FIG. 17, in which the coil springs 280 are placed under tension, as will be later described.

The opening and closing of the frontal jaw portions 276, 278 is accomplished in the following manner. Riding on each of the cam surfaces 272, 274 of each of the upper and lower combs 248, 250 are rotatable wheels or cams 284. Cams 284 are rotatably mounted, in pairs, to cam blocks 286, 288 (see FIGS. 14–16), the cam blocks being, in turn, affixed to supports here shown as carriage rods 289 which slidably move within bores 290, 292 of carriage track means, 256, 258. Thus, the cam blocks 286, 288 and cams 284 are constrained for movement in a direction exactly parallel to the direction of carriage movement.

Also, at the outer face of each cam block 286, 288, there is fixedly attached the forward ends of elongated cam block arms 294, 296, respectively. The rear ends of each cam block arm 294, 296 are affixed, in a conventional manner, to first and second main lever arms 298, 300, respectively. It should be noted that there are numerous control structures for controlling the disclosed sequence of operations. For example, while the preferred embodiment of a machine according to the invention includes timers set to the measured opening and closing times of jaws 276, 278, conventional limit switches may be operated by lever arms 298, 300 to signal the positions of jaws 276, 278, to signal the completion of an anticipated movement.

The extent and timing of longitudinal movement of cam blocks 286, 288 and cam wheels 284 is thus dictated by the extent of movement and sequencing of cam block arms 294, 296, which in turn is dictated by the movement of main lever arms 298, 300.

To move the jaws 276, 278 from the opened position of FIG. 16 to the closed position of FIG. 15, the timed movement of lever arms 298, 300, to be hereinafter described, cause cam block arms 294, 296 to be moved from the forward position shown in FIG. 16 to the rearward position shown in FIG. 16, in the direction of the arrow C. The position shown in FIG. 15 illustrates the rearward end of the stroke of cam block arms 294, 296. The cam wheels 284 are thus moved rearwardly, along cam surfaces 272, 274, causing combs 248, 250 to be pivotally rotated about axes A1, A2 under the influence of coil springs 280 until jaws 276, 278 are closed, or clamped together.

Figure 10:
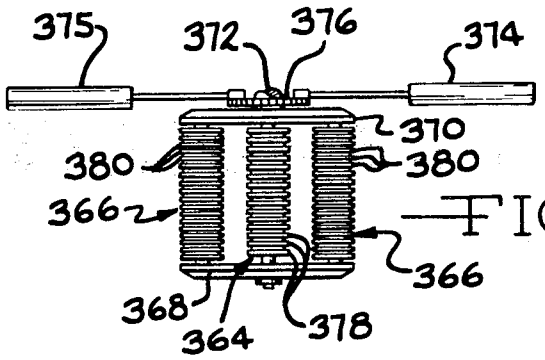
FIG. 10 is a plan view of a turret roller assembly employed during the bonding of a cable according to the invention, and is taken along the line 10—10 of FIG. 9.

To move the jaws 276, 278 from the closed position of FIG. 16 to the open position of FIG. 16, the cam block arms 294, 296, are moved forwardly, from the FIG. 10 position in the direction of arrow B, shown in FIG. 16, under the influence of the timed movement of levers arms 298, 300, and also under the influence of return springs 304.

The return springs 304 constitute a pair of heavy coil springs, one end 306 of each being affixed to each split nut and bolt means 266, and the other end 308 being affixed to a lever arm 298, 300. The coil springs 304 are placed under substantial tension when cam block arms 294, 296 are moved to the rearward position (the closed jaw position) by means of lever arms 298, 300. Later in the sequencing, when the lever arms 298, 300 are moved in the appropriate direction, the return springs 304, cause the cam block arms 294, 296 to be retracted in the direction of the arrow B and thereby force the jaws 276, 278 to open under the influence of the forward movement of cam wheels 284, and to be retained in the open position, the force exerted by return springs 304 overcoming the compressive force exerted by springs 280, as shown in FIG. 16.

Determination of the first level of counter 400, in addition to energizing the reed switches RS1, RS2 to terminate twisting, also energizes a carriage actuator, here shown as a solenoid, designated SOL1 in the drawings, for the purpose of energizing forward carriage movement, preferably after a slight delay. This delay may either be timed, or dependent on switches RS1, RS2, RS3, RS4 indicating the completion of twisting. Preferably, a time delay after switches RS1 and RS2 or RS3 and RS4 close allows untwisted portions of moving conductors 110, 112 to move to jaws 276, 278. The energization of solenoid SOL1 causes the metal core, or solenoid arm 310 thereof to move rearwardly (to the right, in FIG. 18). Solenoid arm 310 carries a U-shaped bracket member 312, which in turn moves the first main linkage arm 298, which has an upper end pivotably mounted to rear carriage block 254 by means of pivot rod 314. The pivot rod 314 is supported on the other side of the carriage 252 by the second main linkage arm 300. As solenoid arm 310 moves rearwardly by energization of SOL1, main linkage arms 298, 300 are pivoted in a counterclockwise direction, as viewed in FIG. 14, about pivot rod 314.

An indication that jaws 276, 278 are closed, such as provided by a timer or by a limit switch, closes an electrical circuit which energizes the carriage motor 318, causing the carriage assembly 252 to move forwardly along track means 256, 258 through conventional linkage 320, carrying the comb structure 246 along with it.

Figure 19:
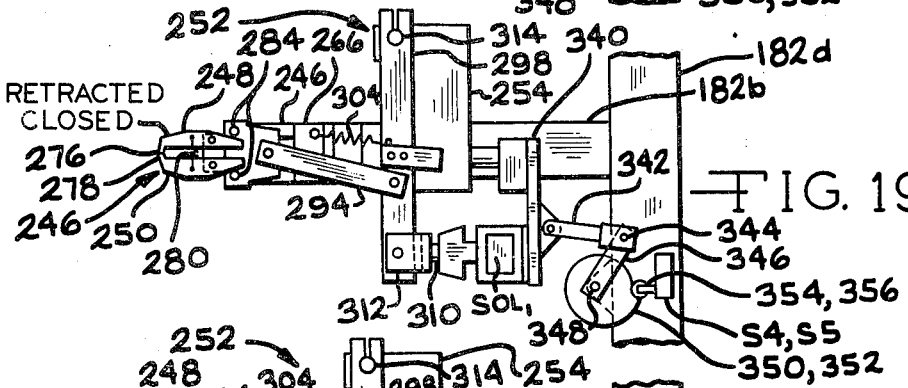

Thus, as the carriage 252 and comb structure 246 commence their forward movement, the upper and lower combs 248, 250 are moved from the open position of FIG. 18 to the closed position of FIG. 19. This occurs, because, as main linkage arms 298, 300 are moved about pivot rod 314, in a counterclockwise direction as viewed in FIGS. 18–21, cam block arms 294, 296 are moved rearwardly, in the direction of arrow C in FIG. 15, to cause cam blocks 286, 288 and cams 284 to also move rearwardly, and thereby close jaw portions 276, 278 as previously described. The compressive force of coil springs 304 is overcome by the rearward movement of cam block arms 294, 296, and springs 304 are placed under tension.

Figure 24:
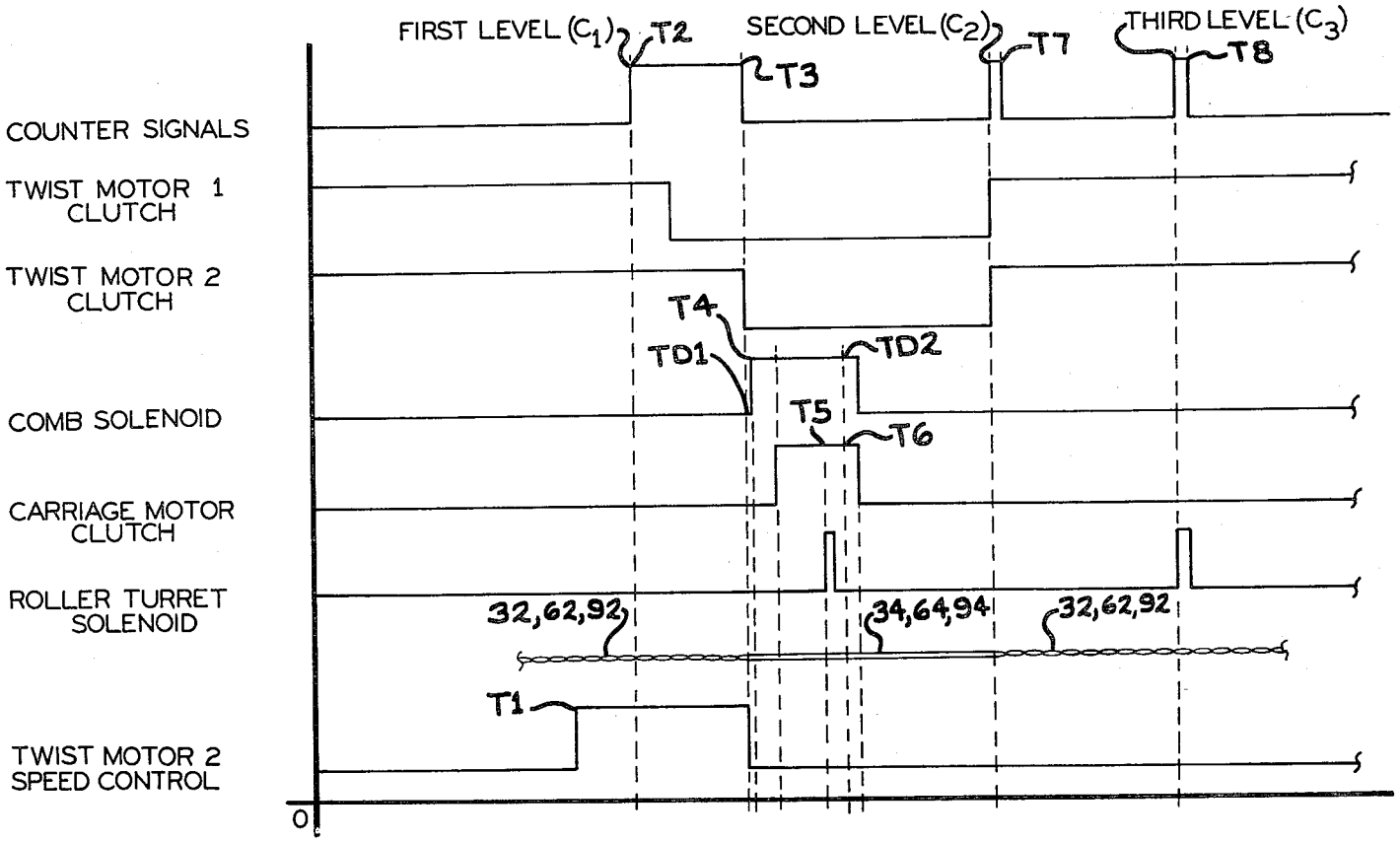
FIG. 24 is a schematic drawing designating the program sequence of one complete cycle of the process and apparatus, and indicating the relationship between the voltages sent to the clutches of the twist motors, comb carriage motor and turret roller solenoid measured against time, and referenced to the alternating twist and straight portions of an improved cable according to the invention.

The carriage solenoid SOL1 is preferably energized after a time delay, through a delay relay DR1 shown in FIG. 24, the time delay being on the order of a fraction of a second, to prevent damage to the conductors by jaw portions 276, 278. As soon as SOL1 is energized, the jaws 276, 278 of combs 248, 250 are closed, and a signaling device such as a timer or limit switch is tripped. It is important that the conductors 110, 112 assume a side-by-side relationship before the jaws 276, 278 close. If the jaws 276, 278 were to clamp down on the conductors 110, 112, before the two banks of conductors assume nontwisted planar side-by-side relationships, the sharp teeth 322, 324 of the combs 276, 278, respectively, would cut the insulation 176 or central metal conductors 174 of the conductors 110, 112. Therefore, time delay DR1 may be set for an adequate time for the slowest or rotating twister tubes 122, 124 to perform a final half rotation, and allow the resulting end of the twisted portion to pass beyond jaws 276, 278. Alternatively, the closure of switches RS1 and RS2 or RS3 and RS4 may be used to provide a signal to begin the delay of DR1.

It is to be noted that the jaws 276, 278, of the combs 248, 250 carry a series of spaced teeth 150, 152, respectively. The V-shaped grooves 326 between the teeth 322, 324 contains each bank of conductors 110, 112 in a precisely laterally spaced manner, which in the embodiment shown, are equal distantly spaced from each other in the lateral direction. In the embodiment shown, the upper bank of conductors 110 are preferably contained within the grooves 154 of the upper comb 248 and the lower bank of conductors 112 contained within the grooves 328 of the lower comb 250.

The vertical spacing between jaw members 276, 278, is preferably adjustable from a zero spacing to perhaps ⅛ inch (0.315 cm) or more to accommodate the processing of insulated conductors of different outside diameters without requiring differently grooved combs. To this end, a lockable adjustable stop means 330 of conventional screw type is located near one side wall of comb 248 and threadably adjusted to produce the desired spacing. The adjustable step means 330 is locked in position by lock nut 332.

It will be seen from the foregoing that comb jaws 276, 278 close, and forward travel of carriage assembly 96 commences almost immediately after the twisting of conductor pair stops. The closed combs 248, 250 thus move with, and precisely laterally align the conductors 110, 112 in a dual planar relationship, as best seen in FIG. 17, almost immediately after twisting ceases. Because the closed combs 248, 250 move together with the moving conductor 110, 112, the conductors are positively maintained in the just-described special relationship until the comb jaws 276, 278 are opened.

The extent of forward travel of comb structure 246 is limited by the application of a carriage brake, by energization of a switch S4, as will be described hereafter. The forward travel is also limited, secondarily, and in positive fashion, by the abutment of the front face 334 of rear carriage block 254 upon the rear face of bushing 260. The mechanical limitation upon the extent of travel of the carriage means can readily be decreased by any number of conventional means, such as by adding spacing between the bushing 260 and carriage block 254.

Figure 20:
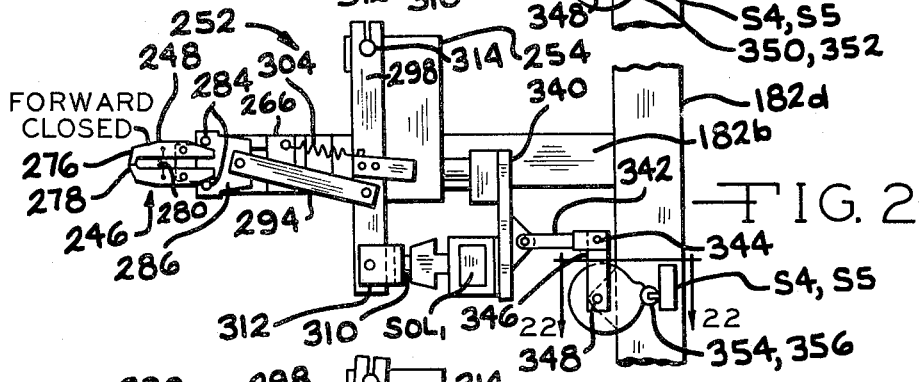

Lamination or bonding of the thus aligned straight conductors will then take place at a time when the comb jaws 276, 278, are closed and in their most forward position, as best seen in FIG. 20. Just prior to reaching the maximum forward position of the carriage assembly, a switch S5 is tripped to de-energize the carriage clutch 336 and energized a carriage brake 338. The turrent roller, to be described below, is also energized at this time. One specific means by which these actions occur will now be set forth.

A generally vertically extending plate 340 is mounted onto comb carriage 252, and moves with it. Mounted to the rear of plate 340 is a rear lever arm 342 which is a generally horizontally disposed bar having a yoke 344 connected to a downwardly extending bar 346, which is fixed to and moves with a pivotally mounted shaft 348. Shaft 348 carries stepped cams 350, 352, adapted to operate switch arms 354, 356 of switches S4 and S5, respectively.

Figure 21:
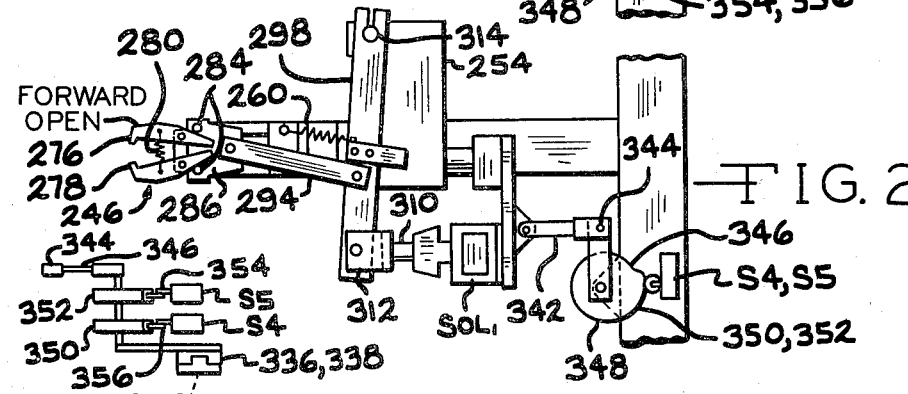
Figure 22:
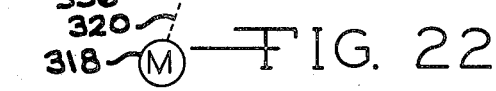
FIG. 22 is a top plan view, taken along the line 22—22 of FIG. 20, showing a switching arrangement to disengage and brake carriage movement and commence turret roller movement.

As the comb carriage 252 moves forward, carrying plate 340 with it, rear lever arm 342 and bar 346 pivot, and rotating shaft 348 moves cams 350 and 352. First, cam 350 will actuate switch arm 356 of switch S4. Then, as carriage 252 reaches the end of its travel, cam 252 actuates switch arm 354 of switch arm S5, at the time the carriage assembly 252 reaches its most forward position, as shown in FIGS. 21 and 22.

It will be noted that cams 350, 352 are stepped cams which can be adjusted by rotating them with respect to shaft 348, so that the time of closing switch S4, which actuates the turret roller as described below, can take place in precisely the proper timing sequence, just prior to the carriage 252 attaining its maximum forward position with the laterally aligned conductors 110, 112 carried by the combs 248, 250. Similarly, the closing of switch S5, which energizes the carriage brake 338 can be precisely timed with the termination of the forward movement of the carriage assembly 252.

In order to precisely align both the twisted conductor pair portions 32, 62, 92, of cables 30, 60, 90 during the time that they are being laminated or bonded to one or more of plastic sheets or films 130, 132, a turrent roller means 360 is provided at the laminating stage 128.

Laminating or bonding section 128 is provided just downstream of the maximum forward position of the comb jaws 276, 278, and comprises generally a turrent roller means 360 and a lower laminating roller 362. Referring to FIGS. 9 and 10, the turret roller means 360 comprises a plurality of elongated, transversely grooved rollers 364, 366, each of the rollers being spaced from the other and being rotatably mounted between roller end support plate 368, 370 about an axis transverse to the movement of cable 30, 60, 90. Passing through the central axis of the roller and support plates 368, 370, is a roller drive shaft 372, drivably connected to a roller actuator, schematically shown as linear actuators 374, 375 acting upon a starwheel 376. In an actual embodiment, actuators 374, 375 are two pneumatic cylinders, more than one such actuator being used so that the time required for a single actuator to retract before extending again would not be a limit on frequency of movement of roller means 360. Also, a brake (not shown) is installed on shaft 362, and energized during the retract cycles of actuators 374, 375. This has been found to reduce overshoot motion of roller means 360 due to its inertia.

The transverse grooves 378 of roller 364 are machined with parallel grooves of sufficient width and depth to contain the twisted conductor pairs and upper laminating film 130, if used. Each of the rollers 366 is machined wth transverse grooves 380 of a narrower width and lesser depth to accommodate the individual straight conductors 110, 112 and the upper laminating film 130, if used.

It will be noted that three of each type of roller 364, 366 is shown in FIG. 9, but that any even number of rollers may also be suitable. It it also noted that rollers 364, hereinafter referred to as the twist rollers, alternate with rollers 366, hereinafter called the straight rollers in the turret roller means 360, so that as the plurality of conductors 110, 112 passes from the twist mode to the straight mode, the turret roller means 360 will be rotatably shifted 60° from the position shown in FIG. 9*a* to the position of FIG. 9*b*, wherein a straight roller 366 is placed in laminating or bonding position.

Figure 9B:
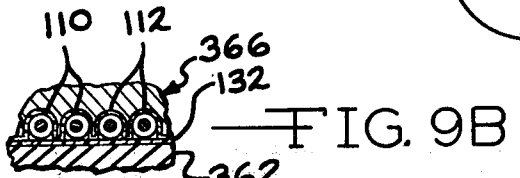
FIG. 9*b* is a cross-sectional view, taken along the same line 9*a*—9*a***, but at a later time when straight conductor portions are being bonded.
Figure 9A:
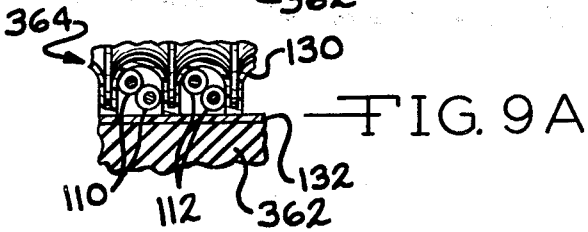

Conversely, when conductors 110, 112 pass from the straight mode to the twist mode, the turret roller means 360 is programmed to rotate such that a straight roller 366 is moved from laminating position of FIG. 9*b* to a point removed 60° therefrom, and thereby place twist roller 364 into laminating or bonding position as shown in FIG. 9*a*.

In the drawings of FIGS. 9 and 9*a*, the turret roller means 360 is shown in a position where twist roller 364 is in laminating or bonding position, and the apparatus of this invention is shown laminating twisted conductor pairs. The next position of turret roller means 360 will present straight roller 366 in laminating position, after the twist mode has ceased and just as the straight conductor portion 34, 64, 94 enters the nip area between the upper roller 364 and lower roller 362, being laterally aligned by closed comb jaws 276, 278 as it enters the nip area. This second position is shown in FIG. 9*b*.

The motion of turret roller means 360 is programmed in the following manner.

Switch actuating step cam 352 will be adjusted to trip switch S5 just prior to the time that carriage assembly 252 is in maximum forward position. When switch S5 is tripped, it energizes a circuit which closes a sequence delay relay, and then applies power to a relay for controlling linear actuator 374. The rotation of turret roller means 360 will be stopped just as the straight roller 366 overlies lower laminating roller 362, and just as straight cable commences to reach the nip area of rollers 182, 196.

Figure 23:
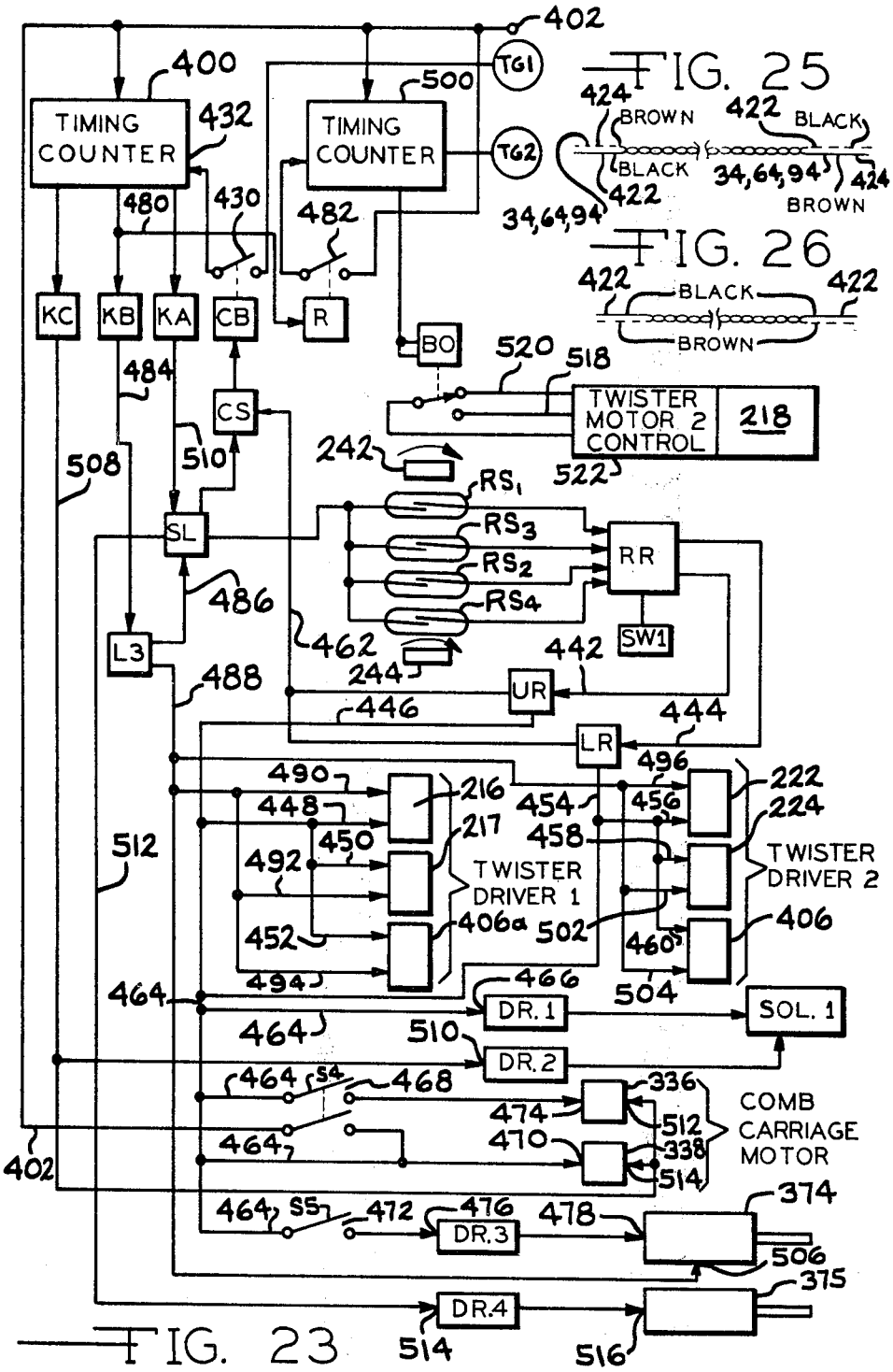
FIG. 23 is a schematic diagram of the electrical interconnections between the major components of the control apparatus of this invention.

Counter 400, shown in FIG. 23, measures the length of the straight conductor portions 34, 64, 94. At the end of the second or C2 level, the twist motor 212, 218, or 226, will be restarted, by means of a signal sent from counter 400 which de-energizes switches RS1, RS2, RS3, RS4 thereby allowing the twist motors to restart.

The tripping of switch S4 causes the carriage clutch 336 to be disengaged, and the carriage brake 338 to be energized, causing carriage assembly 252 to be held in its maximum forward position until after the straight mode of the processing cycle has been completed.

Switch S5 is tripped very shortly after switch S4 is closed, as earlier noted. Thus, the straight roller 366 is placed in laminating position as straight portions 34, 64, 94 arrive at the laminating section 128, and the smooth transition from twist to straight modes in the cable, 30, 60, 90 will take place. A third level of counter 400, third level C3 measures a small length of cable, approximately $\frac{3}{4}$ to $1\frac{1}{2}$ inches (1.9 to 3.8 cm) after the counter second or C2 level has been completed, before opening comb jaws 276, 278. The comb jaw portions are opened just prior to the time the twisted portions of the continuously-moving conductors reach them. Thus, at the end of the third level C3 of counter 400, a relay opens momentarily, to de-energize relays DR1 and DR2, releasing solenoid arms 310 of carriage solenoid SOL1, causing cam block lever arm 294 to move forwardly along cam surfaces 272, 274, enabling the comb jaws 276, 278 to spread apart, before the comb jaws cut into the twisted pairs that have been formed.

Also, as cam block lever arm 294 moves forwardly, the brake 338 of the comb carriage 252 is released, preferably after a slight time delay caused by a delay relay in the circuit, to prevent rearward movement before the jaws 276, 278 were fully opened. However, as will be apparent, a switch actuated by solenoid arm 310 could also start the release of brake 338. As will be apparent to a machine tool logic designer, many machine functions may be controlled either by a switch sensing mechanical movement, or a timer set to anticipated movement time. Therefore, one may be substituted for the other freely in accordance with the invention.

The carriage 252 is then retracted, under the influence of a strong coil carriage spring 382, to a position wherein the carriage block 254 abuts the rear bushing 260. The forward end 384 of spring 382 is affixed to the carriage block 254, and the rear end 202 is affixed to twister frame 182 in conventional manner. The comb carriage 252 is now ready for its next cycle, at an appropriate time.

Also, at the end of the third counter level, the second roller sequence delay relay DR4, and actuator 375 are energized, to initiate the rotation of turret roller means 360, over a 60° angle, to position twist roller 364 and lower roller 362 in an overlying relationship, as shown in FIG. 9*a*, ready to accept and precisely laterally aligned twisted conductive pairs during their lamination or bonding.

It is important to note that the rotation of turret roller means 360 is initiated at the end of the second or C2 counter level and twisting commenced prior to the opening of comb jaws 276, 278, since comb jaws are opened only at the end of the later third counter or C3 level. It will be seen that if twisting starts before the comb jaws are released, and are then released after a set short time, an initial transition zone of a predetermined length is made. Ideal presetting of counter level C3 will result in an initial transition zone with a lay which is substantially identically to that of longitudinally adjacent sections of conductors 110, 112. As will be apparent, too long of a delay will result in twisted conductor pairs 110, 112, being cut by jaws 276, 278, and too short a delay will result in an excess length of straight section 34, 64, 94.

The process and apparatus of this invention also includes means for heating the upper and lower laminating sheets 130, 132, if used, to their softening point, by means of hot air, blown through air nozzles 388. The air nozzles 388, through which the hot air exits, are placed closely adjacent the nip area of rollers 364 or 366 and lower 362. The critical temperatures necessary for bonding, or avoiding the bonding of a particular type of plastic laminating film such as 130, 132 are well-known in the art.

It will be noted, from FIG. 9, that comb structure 246 is moved closely adjacent the exit end of air nozzles 388 during its course of travel. In order that the comb structure 246 be kept as cool as possible and not exceed the softening temperatures of the conductor insulation 176, the combs 248, 250 are provided with cooling passages 390, 392, through which a suitable coolant fluid is passed in order to maintain the combs at the desired low temperature.

After the lamination or bonding of the cable 30, 60, 90, the cable passes under the around cooling roller 394, and over a cold roller 396, and then proceeds to be wound onto a take-up spool, not shown, by conventional means. A second take-up spool, not shown, may be provided for collecting unbonded film, if used.

The cable 30, 60, 90 is pulled through the various processing stations under a constant tension, by conventional means, and at a rate of speed that is in the order of 500 to 1500 feet per hour, or greater, but which may be readily varied. Imprinting of the cable 30, 60, 90, may take place prior to cooling, if desired, by conventional means, designating schematically by reference numeral 398.

Referring to FIGS. 23 and 24, a summary of the sequence of operation performed by the method and apparatus of this invention will be set forth, with particular attention to the electrical connection. However, as will be apparent, one having minimal experience in the field of machine control logic could easily construct a different but equivalent control circuit, having different types of position sensing elements and different types of actuators, from the description of mechanical movements of the apparatus above. Therefore, emphasis will be placed on circuit function.

The timing counter 400 measures the C1, C2 and C3 levels, initiating one at the end of the previous one, and at the end of the C3 level, all levels reduce to zero to start the next cycle. Timing counter 400 is a conventional 16 level counter, making it apparent that other levels of counter 400 may be used for machine control functions.

Timing counter 500 is a two-level timing counter, responsive to timing generator TG2, which measures and controls the length of the two lays 54 and 58 of conductor pairs 56, 57 shown in FIG. 1. It is reset by counter 400, and controls a motor such as motor 218 to one of two preset speeds.

The circuit shown in partially symbolic form in FIG. 24 is adapted to manufacture the embodiment of ribbon cable shown in FIG. 1. However, to produce the cables shown in FIGS. 2 and 3, the illustrated circuit may be easily modified. For instance, to produce cable 60 shown in FIG. 2, timing counter 500 may merely be set to zero, motor 218 then running at a single speed. To produce cable 90, as shown in FIG. 3, the speed of motor 218 may be adjusted to match the speed of 212, or, alternatively, referring for a moment to FIGS. 13 and 14, motors 212 and 218 and clutches 216 and 222 may be replaced by motor 226, gears 228 and 230, and clutches 240 and 244, to operate twisters 122 and 124 from a single motor.

When AC supply power is provided to terminal 402, it may be assumed that motors 212 and 218 or 226 are operating, and a twisted pair cable section 32, 62, 92 is being produced. Timing counter 500, responsive to timing generator TG2, as will be explained more fully below, will control the speed of motor 218, if appropriate.

As the machine according to the invention is making twisted cable section 32, 62, 92, timing counter 400, responsive to timing generator TG1, counts the length of one section, such as the twisted section, down to a preset value and then begins counting on another preset level. The end of the last preset level resets counter 400 to the first preset level. At the end of the first preset count, the level one relay, shown as relay KA, is activated. Actuation of relay KA activates sequence latch relay SL, which latches in an energized state. Sequence latch relay activates the count block relay CB through the cycle start relay CS, operating contacts 430 to interrupt the signal applied to input 432 of counter 400 by timing generator TG1. Thus, the time required for twisters 122, 124 to stop will not be counted as part of the length of the cable by counter 400. When sequence latch relay SL is actuated, it applies power to reed switches RS1, RS2, RS3, RS4, which are responsive to rotating magnets 242, 244. The opposite contact of each of these reed switches is connected to ratchet relay RR, a commercially available DPDT relay, with moving contacts that change state each time it is energized. Ratchet relay RR is provided to allow the production of cables such as shown in FIGS. 25 and 26, with paired wires that may interchange in position at alternate flat sections 34, 64, 94. It may be disabled by switch SW1. As illustrated, reed switches RS1 and RS3 are connected with an upper twister 122, and reed switches RS2 and RS4 are associated with lower twister 124, to stop twister tubes in a predetermined relationship. In effect, ratchet relay RR interchanges switches RS1 and RS3, and RS2 and RS4, located 180° apart, to allow stopping twisters 122, 124 at either of two positions spaced 180° apart. From ratchet relay RR, signals from RS1 or RS3, and RS2 or RS4, are applied to upper relay UR and lower relay LR, respectively, through lines 442 and 444, respectively. When switch RS1 or RS3, as selected by ratchet relay RR, is actuated, relay UR is actuated, applying a signal to line 446, connected to release input 448 of clutch 216, apply input 450 of brake 217 and extend input 452 of solenoid actuator 406, shown in FIG. 13, thus stopping one twister assembly in a predetermined position by disengaging clutch 216, applying brake 217 and extending rod 408 to engage cam device 404. Correspondingly, when reed switch RS1 or RS2, as appropriate, is actuated, a signal will be applied to lower relay LR, which will result in a signal upon line 454, connected to input 456 of clutch 222, input 458 of brake 224, and input 460 of actuator 406*a*, thus disengaging motor 218 and braking and stopping twister 124.

It should be noted that count block relay CB is provided to minimize the variation of the length of the flat section of the cable being produced.

When both upper relay UR and lower relay LR indicate that both sets of twisters 122, 124 are stopped, a signal is provided to cycle start relay CS on line 462, and also on line 464, operating the cycle start relay CS to de-energize the counter block relay CB, closing contacts 430, and restarting timing counter 400. The signal appearing on line 464 is connected to input 466 of delay relay DR1, to contacts 468 of switch S4, to input 470 of carriage brake 338, and to contacts 472 of switch S5. After a delay set by delay relay DR1, SOL1 is energized, closing jaws 276, 278, as shown in FIG. 20. Carriage brake 338 is released, and carriage clutch 336 is engaged, causing the comb carriage to move towards the position shown in FIG. 20. During this movement, cams 350, 352, rotate, actuating switches S4 and S5, switch S4 being actuated slightly before S5. Actuating switch S4 removes power from input 474 of carriage clutch 336, and applies it to input 470 of carriage clutch 338, maintaining the comb carriage in the position shown in FIG. 20. When switch S5 closes, power is applied to input 476 of delay relay DR3, which, after a short time delay, applies power to input 478 of actuator 374, causing turret roller means 360 to index from twist roller 364 to flat roller 366, shown in FIG. 10.

The subject machine will now make a flat section of cable whose length is determined by the number preset into the second level of timing counter 400. At the end of the preset count of the second level C2 of timing counter 400, relay KB is actuated, and a signal is applied to line 480 to open contacts 482 of reset relay R, allowing timing counter 500 to begin to count. Also, relay KB energizes level three relay L3, which in turn, through line 486, controls sequence latch relay SL to remove power from reed switches RS1, RS2, RS3, and RS4. Level three relay L3 also, through line 488, connected to input 490 of clutch 216, input 492 of brake 217 and input 494 of actuator 406*a*, and to input 496 of clutch 222, to input 502 of brake 224, and to input 504 of actuator 406, thus starting twisters 122 and 124 by releasing brakes 217, 224, retracting rods 408, 408*a* and engaging clutches 216, 222. The signal appearing on line 488, also being connected to input 506 of actuator 374, causes actuator 374 to retract.

The second level, level C2 of timing counter 400 is preset to be in effect for the time required for the twisted portion of the cable resulting from starting of twisters 122, 124, to reach turret roller means 360 and lower laminating roller 362. At the end of this second level time, timing counter 400 actuates relay KC, which applies a signal to line 508, connected to input 510 of delay relay DR2, and to inputs 512 and 514 of carriage clutch 336 and carriage brake 338, respectively. Thus, after a short delay set by delay relay DR2, as the twisted portion of conductors 110, 112 reach jaws 276, 278, jaws 276, 278 will open, and carriage brake 338 will be released, allowing the comb carriage to move to the position shown in FIG. 22.

At the end of the third level C3, as indicated by the momentary closure of contacts of relay KC, the subject machine is in the state described as the first level, with the timing counter 400 operating on the first level, and contacts of relay KA, through line 510, control relay SL to apply a signal to line 512, which is connected to input 514 of delay relay DR4. After a time delay set by delay DR4, set appropriately to allow the beginnings of the twisted portions of conductors 110, 112 to move past the opening and retracting jaws 276, 278 to the contact point between roller means 360 and laminating roller 362, actuator 375 extends, indexing roller means 366 from a flat roller 366 to a twist roller 364. Meanwhile, timing counter 500 is counting at its first level, corresponding to, for instance, the length of twisted section 42 in which it is desired to have a lay 54 for conductor pairs 56, 57, etc. That interval having been measured by timing generator TG2, timing counter 500 switches to its second preset level and actuates a batch output relay B0, which is a SPDT relay, and selects high speed control input 518 of motor controller 522, to provide a lay 58, as shown in FIG. 1, to minimize the length of transition region 38.

At the end of first level C1 of counter 400, and beginning of second level C2 of counter 400, timing counter 500 will be reset through line 480 and reset relay R, causing batch output B0 to select low speed input 520 of motor controller 522, causing motor 218 to revolve at a low speed to produce a long lay such as lay 54 shown in FIG. 1, after the completion of the flat section formed during the second level C2 of timing counter 400. For example, assuming a cable being made at the rate of 950 feet per minute, and a second lay 54 and third lay 58 of 2 inches and 0.75 inches, respectively, is desired, motor 218 may be adjusted to rotate at 39.5 RPM until time T1, and then caused to accelerate to and maintain 158 RPM until time T3.

FIGS. 25 and 26 illustrate a ribbon cable produced by interchanging switches RS1 and RS2, and RS3 and RS4, as shown in FIG. 23, by operation of ratchet relay RR, or the like. As shown in FIGS. 25 and 26, a cable having the paired conductors 110, 112 reversed within each pair at alternate straight sections 34, 64, 94, may be produced by machine in accordance with the invention. If reed switches RS1, RS2 are energized at the end of a first counter level C1, all twister tubes 122, 124 will be precisely aligned so that the lines drawn between the axis of each conductor of a pair are substantially horizontal and planar as they exit from the twister tubes. However, if reed switches RS3, RS4 are energized, they cause twister tubes 122, 124 to be aligned substantially exactly 180° removed from that occurring when reed switches RS1, RS2 are energized. Thus, if switches RS1, RS2 are energized in a first sequence of operations to thereby commence the formation of a first straight conductor portion 34, 64, 94, following by an energization of switches RS3, RS4 in the next sequence of operations to commence the formation of the next successive straight conductor portion, this next successive straight conductor portion will have each conductor pair thereof aligned 180° out of phase with that of the first straight conductor portions.

Accordingly, in the schematic plan view of twist and straight portions 32, 62, 92 and 34, 64, 94 shown in FIGS. 25 and 26 wherein a black and brown conductor pair is shown, the upper black conductor 422 becomes the lower conductor of an adjacent straight portion 34, 64, 94 and brown conductor 424 also reverses. This alternating arrangement of the placement of paired conductors in successive straight conductor portions is of advantage in come types of mass termination techniques, such as for making connection between devices fabricated in a mirror-image fashion. Where alternative energization between switches S1, S2 and switches S3, S4 does not take place, the conductors of each pair would be as shown in FIG. 26 where the upper flat conductors 422 is also the upper conductor of each succeeding or preceding straight conductor portion.

It will be understood that numerous other modifications of the multiconductor cable of this invention, and of the method and apparatus for making it, including but not limited to variations in the exact mechanical structure of the apparatus, may be made by one skilled in the art, without departing from the spirit and scope of the invention.

I claim:

1. Apparatus for making multiple conductor ribbon cable having a plurality of longitudinally extending insulated conductor pairs and having twisted conductor portions serially alternating with straight conductor portions, comprising:

first means for supplying a plurality of first conductor pairs and continuously twisting said first conductor pairs in a first direction;

second means for supplying a plurality of second conductor pairs and continuously twisting said second conductor pairs in a second direction;

first twister means for precisely intermittently starting and stopping to intermittently twist said first conductor pairs in said first direction to form a plurality of first twisted conductor portions having a twist length of a first predetermined distance and a plurality of first straight conductor portions having a predetermined length;

second twister means for precisely intermittently starting and stopping to intermittently twist said second conductor pairs in said second direction to form a plurality of second twisted conductor portions having a twist length of a second predetermined distance and a plurality of second straight conductor portions having said predetermined length;

means for maintaining said first conductor pairs and said second conductor pairs as said straight conductor portions for a predetermined distance after said stopping of said first twister means and of said second twister means;

means for applying a first sheet of plastic film to one first side of said insulated conductor pairs to adhere to both said first and said second twisted conductor portions and said first and second straight conductor portions upon subsequent bonding of said conductor portions and said first plastic film;

means for bonding said first plastic film to said first and second twisted conductor portions and to said first and second straight conductor portions;

said means for bonding including third means for precisely laterally aligning said first and second twisted conductor portions during the bonding thereof to said first plastic film and fourth means for precisely laterally aligning said first and second straight conductor portions during the bonding thereof to said first plastic film;

said third means including a first roller having a series of channels therein for precise lateral spacing of each said twisted conductor portion during bonding of said first and second twisted conductor portions;

said fourth means including a second roller having a series of channels therein for precise lateral spacing of each said straight conductor portion during bonding of said first and second straight conductor portions; and means for sequentially positioning said first roller and said second roller for bonding of said serially alternating twisted conductor portions and said straight conductor portions.

2. An apparatus for making multiple conductor ribbon cable according to claim 1, including:

means for applying a second plastic film to a second side of said insulated conductor pairs to adhere to both said first and second twisted conductor portions and said first and second straight conductor portions upon subsequent bonding of said conductor portions and said second plastic film;

said means for bonding being adapted to bond said second plastic film to a second side of said insulated conductor pairs to laminate said insulated conductor pairs between said first plastic film and said second plastic film to encapsulate said first and second twisted conductor portions and said first and second straight conductor portions therebetween.

3. An apparatus according to claim 1 or 2, wherein:

said first twister means for precisely intermittently starting and stopping to twist said first insulated conductor pairs includes a plurality of first twister tubes through which said first insulated conductor pairs are adapted to travel, and includes first twist indexing means for stopping said first twister tubes in a first precisely predetermined orientation;

said second twister means for precisely intermittently starting and stopping to twist said second insulated conductor pairs includes a plurality of second conductor tubes through which said second insulated conductor pairs are adapted to travel, and includes second twist indexing means for stopping said second twister tubes in said first precisely predetermined orientation.

4. An apparatus according to claim 3, wherein:

said second twister means is offset from said first twister means in the direction of travel of said first and second insulated conductor pairs;

said apparatus includes means for substantially simultaneously intermittently starting said first twister tubes and said second twister tubes;

said first twisted conductor portions being longitudinally offset from said second twisted conductor portions.

5. An apparatus according to claim 3, including:

timing counter means responsive to travel of said multiple conductor ribbon cable for providing a signal indicative of completion of one said serially alternating twisted conductor portions to said first twist indexing means and to said second twist indexing means, said first twist indexing means and said second twist indexing means being responsive to said signal;

said first indexing means including first magnetic means mounted to one of said first twister tubes and first switch means responsive to said first magnetic means for stopping said first twister tubes in said precisely predetermined orientation;

said second indexing means including second magnetic means mounted to one of said second twister tubes and second switch means responsive to said second magnetic means for stopping said second twister tubes in said precisely predetermined orientation;

said first switch means and said second switch means being enabled in response to said signal indicative of completion of one said serially alternating twisted conductor portion.

6. An apparatus according to claim 3, wherein:

said first twist indexing means and said second twist indexing means include third and fourth switch means responsive to said first and second magnetic means respectively for stopping said first twister tubes and said second twister tubes respectively in a second precise orientation which is substantially 180° removed from said first predetermined orientation.

7. The apparatus of claim 3, wherein:

each of said first twister tubes and each of said second twister tubes includes a means for separating a pair of individual insulated conductors as they pass through said twister tubes whereby the conductors forming a pair are twisted only at the exit end of each of said twister tubes.

8. The apparatus of claim 7, wherein:

said means for separating a pair of individual insulated conductors includes a pair of tubes extending within substantially the entire length of each of said first twister tubes and each of said second twister tubes and mounted within each of said twister tubes for rotation with said twister tubes.

9. The apparatus of claim 1, wherein:

said means for precisely starting and stopping the twisting of said insulated conductor pairs comprises:

a plurality of rotatable elongated first twister tubes and a plurality of second twister tubes through each of which a pair of insulated conductors is adapted to pass, and means for rotating said first twister tubes in unison and means for rotating said second twister tubes in unison.

10. The apparatus of claim 1, wherein:

said first twister means for precisely starting and stopping the twisting of said first insulated conductor pairs includes a plurality of first rotatable elongated tubes converging towards the downstream side of the tubes into an upper bank;

said second twister means for precisely starting and stopping the twisting of said second insulated conductor pairs includes a plurality of second rotatable elongated tubes converging towards the downstream end of the tubes into a lower bank underlying said upper bank; and said apparatus further including means for rotating said first tubes in unison and for rotating said second tubes in unison.

11. The apparatus of claim 1, wherein:

said means for maintaining a series of straight conductor portions after termination of twisting includes a comb means moving with, and between, individual insulated conductors, to maintain the precise lateral spacing between said conductors after termination of twisting and just prior to bonding of said straight conductor portions.

12. The apparatus of claim 1, wherein:

said means for maintaining each of said first conductor pairs and each of said second conductor pairs as straight conductor portions after stopping of twisting includes:

comb means provided with openable and closeable jaw members;

carriage means for moving said comb means from a first upstream position to a second downstream position after stopping of twisting of said insulated conductor pairs and prior to their bonding;

means for closing said jaw member of said comb means between individual insulated conductors, when said carriage means is in said first upstream position, to maintain precise lateral spacing between said individual insulated conductors shortly after stopping of twisting of said insulated conductor pairs and prior to bonding;

and means for retaining said jaw members of said comb means in closed position as said carriage means moves from said first upstream position to said second downstream position.

13. The apparatus of claim 12, wherein:

said means for sequentially positioning said first and second rollers include means for placing said second roller into bonding position just prior to said carriage means attaining its said second downstream position.

14. The apparatus of claim 12, wherein:

said means for sequentially positioning said first and second rollers into position includes means for placing said first roller into bonding position a predetermined time after said first means for twisting said first insulated conductor pairs and said second means for twisting said second insulated conductor pairs have commenced.

15. The apparatus of claim 1, wherein:

said means for sequentially positioning said first and second rollers includes means for placing said first roller into bonding position a predetermined time after said first means for starting said twisting of said first insulated conductor pairs and said second means for starting said twisting of said second insulated conductor pairs has commenced.

16. The apparatus of claim 12, wherein:

a time delay means is provided between the time of closure of said jaw members and termination of twisting of individual conductors whereby said jaw members retain said insulated conductors in nontwisted position to thereby avoid damage to said insulated conductors.

17. The apparatus of claim 1, wherein:

said means for maintaining each of said first insulated conductor pairs and each of said second insulated conductor pairs as straight conductor portions after stopping of twisting includes:

comb means provided with openable and closeable jaw members;

carriage means for moving said comb means from a first upstream position to a second downstream position after stopping of twisting of said insulated conductor pairs and prior to their lamination;

means for closing said jaw members of said comb means between individual insulated conductors, when said carriage means is in said first upstream position, to maintain precise lateral spacing between said individual insulated conductors shortly after stopping of twisting of conductor pairs and prior to lamination;

means for retaining said jaw members of said comb means in closed position as said carriage means moved from said first upstream position to said second downstream position; and means for opening said jaw members of said comb means and means for retracting said carriage means to said first upstream position a predetermined time after twisting of insulated conductor pairs has been restarted in a next cycle of operation.

18. The apparatus of claim 17, wherein:

said means for opening of said jaw members is actuated a predetermined time period after said means for retracting said carriage means commences to avoid damage to said insulated conductors.

19. The apparatus of claim 1 which includes:

means for varying the rate of travel of said insulated conductor pairs.

* * * * *